US010959543B2

(12) United States Patent
Wills et al.

(10) Patent No.: US 10,959,543 B2
(45) Date of Patent: Mar. 30, 2021

(54) TRAY ACCESSORY AND TRAY WITH MOUNTING STRUCTURE

(71) Applicant: Retail Space Solutions LLC, Milwaukee, WI (US)

(72) Inventors: Matthew Wills, Grafton, WI (US); Julia Padvoiskis, Milwaukee, WI (US)

(73) Assignee: Retail Space Solutions LLC, Milwaukee, WI (US)

( * ) Notice: Subject to any disclaimer, the term of this patent is extended or adjusted under 35 U.S.C. 154(b) by 0 days.

(21) Appl. No.: 16/421,354

(22) Filed: May 23, 2019

(65) Prior Publication Data

US 2019/0357701 A1 Nov. 28, 2019

Related U.S. Application Data

(60) Provisional application No. 62/803,989, filed on Feb. 11, 2019, provisional application No. 62/676,759, filed on May 25, 2018.

(51) Int. Cl.

| | |
|---|---|
| ***A47F 5/08*** | (2006.01) |
| ***A47F 1/12*** | (2006.01) |
| ***A47F 7/00*** | (2006.01) |

(52) U.S. Cl.

CPC ..... *A47F 5/0823* (2013.01); *A47F 1/125* (2013.01); *A47F 7/0007* (2013.01)

(58) Field of Classification Search

CPC ..... A47F 1/125; A47F 1/126; A47F 1/128; A47F 5/005

See application file for complete search history.

(56) References Cited

U.S. PATENT DOCUMENTS

| | | | | |
|---|---|---|---|---|
| 4,475,658 A | | 10/1984 | Roberts et al. | |
| 4,856,658 A | | 8/1989 | Novak | |
| 4,874,099 A | | 10/1989 | Arnott et al. | |
| 4,907,707 A | * | 3/1990 | Crum | A47F 1/126 206/556 |
| 5,012,936 A | * | 5/1991 | Crum | A47F 1/126 206/556 |
| 5,123,546 A | * | 6/1992 | Crum | A47F 1/126 206/556 |

(Continued)

FOREIGN PATENT DOCUMENTS

WO 2018200997 A1 11/2018

*Primary Examiner* — Stanton L Krycinski

(74) *Attorney, Agent, or Firm* — Andrus Intellectual Property Law LLC

(57) ABSTRACT

A product display merchandiser comprises a tray having a product supporting surface; a first sidewall adjacent a first side of the tray; a second sidewall adjacent a second side of the tray; and a bracket configured to detachably mount the product display merchandiser to a support. The product display merchandiser is further configured with at least one of the following: the first and second sidewalls each having a respective sidewall vertical portion with a rear edge that is angled away from a rear of the product display merchandiser; the bracket having a tray-supporting portion that is oriented at an acute angle with respect to a support-engaging portion; and/or the bracket having at least two types of engagement members for mounting the product display merchandiser to either of at least two types of supports.

22 Claims, 18 Drawing Sheets

(56) References Cited

U.S. PATENT DOCUMENTS 5,366,099 A * 11/1994 Schmid ..... A47F 1/126 211/175
5,665,304 A * 9/1997 Heinen ..... A47F 1/126 108/110
5,746,328 A 5/1998 Beeler et al.
5,769,248 A 6/1998 Johnson
5,855,283 A 1/1999 Johnson
5,906,283 A 5/1999 Kump et al.
5,970,887 A 10/1999 Hardy
6,079,574 A 6/2000 Mylander et al.
6,129,222 A 10/2000 Mylander et al.
6,227,385 B1 5/2001 Nickerson
6,352,162 B1 3/2002 Yang et al.
6,357,606 B1 3/2002 Henry
6,539,280 B1 3/2003 Valiulis et al.
6,561,362 B1 5/2003 Cummins
6,850,208 B1 2/2005 Ferrante
7,168,579 B2 1/2007 Richter et al.
7,458,473 B1 12/2008 Mason
7,559,437 B2 7/2009 Colelli et al.
7,681,744 B2 3/2010 Johnson
7,681,745 B2 3/2010 Richter
7,703,614 B2 * 4/2010 Schneider ..... A47F 3/14 211/184
8,066,128 B2 11/2011 Crawbuck et al.
8,453,851 B2 * 6/2013 Ciesick ..... A47F 1/04 211/126.15
8,479,927 B2 7/2013 Vulpitta
8,720,702 B2 5/2014 Nagel
9,101,230 B2 * 8/2015 Sosso ..... A47F 1/125
9,138,076 B2 * 9/2015 Hardy ..... A47B 57/58
9,339,123 B1 5/2016 Stoddard et al.
9,392,885 B2 7/2016 Vogler et al.
9,408,478 B2 * 8/2016 Vogler ..... A47F 5/0093
9,521,913 B2 12/2016 Vogler et al.
9,629,479 B2 * 4/2017 Sosso ..... A47F 1/125
9,642,475 B2 5/2017 Volger et al.
9,713,394 B1 * 7/2017 Bruegmann ..... A47F 1/126
9,986,852 B2 * 6/2018 Chenoweth ..... A47F 3/001
10,034,557 B1 7/2018 Nagel
10,154,739 B2 12/2018 Turner et al.
2003/0217980 A1 11/2003 Johnson et al.
2005/0077259 A1 * 4/2005 Menz ..... A47F 1/125 211/59.3
2006/0186065 A1 * 8/2006 Ciesick ..... A47F 1/126 211/59.3
2007/0175839 A1 * 8/2007 Schneider ..... A47F 1/126 211/59.3
2008/0237164 A1 10/2008 Davidson et al.
2010/0025346 A1 2/2010 Crawbuck et al.
2010/0107670 A1 5/2010 Kottke et al.
2017/0202369 A1 7/2017 Mercier et al.
2017/0251835 A1 9/2017 Fluegge et al.
2017/0273477 A1 9/2017 Mercier et al.
2018/0020848 A1 1/2018 Mercier et al.
2018/0103775 A1 4/2018 Kaczmarek et al.
2018/0110345 A1 * 4/2018 Sun ..... A47F 1/12
2018/0153313 A1 6/2018 Padvoiskis et al.
2018/0325285 A1 11/2018 Hardy
2018/0354532 A1 12/2018 Vogler et al.
2018/0360233 A1 12/2018 Turner et al.
2020/0093282 A1 3/2020 Bruegmann

* cited by examiner

TRAY ACCESSORY AND TRAY WITH MOUNTING STRUCTURE

CROSS-REFERENCE TO RELATED APPLICATIONS

The present application claims priority to and the benefit of U.S. Provisional Application Ser. No. 62/676,759, filed May 25, 2018, and U.S. Provisional Application Ser. No. 62/803,989, filed Feb. 11, 2019, both of which are hereby incorporated by reference herein in their entireties.

FIELD

The present disclosure relates generally to product displays and, more particularly, to tray merchandisers having a mounting structure for mounting on a support.

BACKGROUND

U.S. Pat. No. 5,769,248 discloses a product display grid system including a grid and various product hangers. The grid is comprised of spaced vertical and spaced horizontal members. The product hangers such as shelves, cups, hook and trays have attachment members that secure the product hangers to the horizontal elongate members of the grid. The product hangers support and display the products.

U.S. Pat. No. 5,855,283 discloses a product display including a track, a tray having a top surface upon which products are displayed, and interengagable members on the track and tray for enabling the tray to have a first mode of operation wherein the interengagable members are disengaged allowing the tray to move relative to the track and a second mode of operation wherein the interengagable members are interengaged prohibiting movement of the tray relative to the track. A biasing member urges products on the displayed toward the front of the display. Adjustable guide members are positioned adjacent the display surface for containing products on the display surface. The guide members are adjustable to accommodate various sizes of products.

U.S. Pat. No. 6,227,385 discloses a self-facing, add-on shelf system made up of universal base, divider, front, and rear sections. Universal in the sense that these sections form basic building sections for constructing shelf systems of various sizes and operational mode. The front and rear track sections are identical and can be combined with various combinations of bases, dividers and end sections to provide systems of different, desired widths. The depth of the self-facing shelf is generally set by the depth of the shelf with which it is to be used. The individual sections can be selected and combined to provide center pusher, side pusher, and gravity feed types of self facing systems. The bases, dividers and end sections are configured such that they can be extruded and interlock in assembly.

U.S. Pat. Nos. 7,168,579 and 7,681,745 disclose merchandising systems providing for the presentation and storage of articles comprising a base having a front and a back, the base being configured to support the articles and defining a first space for containing the articles. In addition, the merchandising system comprises an assembly for advancing the articles toward the front of the base, wherein the assembly comprises a member configured to extend beyond the base to create a second space for containing the articles in addition to the first space.

U.S. Pat. No. 7,681,744 discloses a merchandising system for articles comprising a base comprising an upper surface having a plurality of ribs, an underside having a plurality of supports formed integrally with the underside of the base, and a first side and a second side. The merchandising system comprises a frame coupled to the base and configured to couple with a shelving system for supporting the base in a substantially horizontal configuration, a first guide and a second guide coupled to the base for supporting articles, and an assembly for advancing the articles that is coupled to the base and provides force on the articles.

U.S. Pat. No. 10,154,739 discloses a universal front-facing merchandiser having a front rail having a first mating structure and a plurality of integrated pusher and divider assemblies. Each divider assembly includes a second mating structure that corresponds to and mates with the first mating structure to couple the integrated pusher and divider assemblies to the front rail. The mating structures of each pusher and divider assembly and the front rail are movable between a first position where the integrated pusher and divider assembly is coupled to and laterally movable about the front rail and is not removable from the front rail without force being applied to the integrated pusher and divider assembly and a second position where the integrated pusher and divider assembly is secured to the front rail in a desired position in a manner that hinders lateral movement of the integrated pusher and divider assembly.

U.S. Patent Application Publication No. 2010/0107670 discloses a ventilated merchandising system for products displayed in merchandise coolers such as refrigerator or freezer cases. One embodiment of the merchandising system includes a base member and a platform coupled to the base member such that air can flow between the platform and the base member. One or more plenum plates can be coupled to the base for directing air between the platform and the base member. A pusher plate may also be coupled to and movable along the platform for advancing products along the platform. A baffle system that may be coupled to a merchandising tray and a method of distributing air flow within a merchandise cooler unit are also provided.

U.S. Patent Application Publication No. 2017/0202369 discloses a product display merchandiser comprising a track, a pusher configured to move along the track, a biasing mechanism configured to apply a force on the pusher in one direction along the track, and a distance sensor configured to detect the distance between the pusher and a fixed point. The distance sensor determines the number of products contained in the product display merchandiser based on the distance measured.

U.S. Patent Application Publication No. 2017/0251835 discloses a product display including a tray, a first product channel located on a first side of the tray, and a second product channel located on a second side of the tray. In some embodiments the first product channel is located on top of the tray and the second product channel is located below the tray.

U.S. Patent Application Publication No. 2017/0273477 discloses a product display merchandiser comprising a tray, a spring biased pusher slidable within the tray, and a visual indicator comprising at least one light activated by a switch, the switch configured to be actuated when the pusher is within a predetermined portion of the tray.

U.S. Patent Application Publication No. 2018/0020848 discloses a product display merchandiser comprising a support member, an intermediate member movably attached to the support member, and a product support attached to the intermediate member. The intermediate member being movable between at least a retracted position and an extended position.

U.S. Patent Application Publication No. 2018/0103775 discloses a product display merchandiser comprising a base configured to be coupled to a shelving unit, a tray defined by at least one sidewall, wherein the tray is movable relative to the base, a lens positioned at a front end of the tray, and a lighting element configured to illuminate the lens. A retrofitting system comprising a light pipe and a body for connecting the light pipe to a merchandiser.

U.S. Patent Application Publication No. 2018/0153313 discloses a shelf management system having a tray defining a first mating structure and a second mating structure, a shelf management component having a spring biased pusher connected thereto and movable between a first position wherein the pusher is extended to a rear of the shelf management component and a second position wherein the pusher is retracted to a front of the shelf management component, and an interstitial member positioned between the shelf management component and the tray to secure the shelf management component to the tray and hinder lateral movement of the shelf management component with respect to the tray. Improved components of the shelf management system are also disclosed as are methods relating to same.

U.S. Patent Application Publication No. 2018/0360233 discloses a product display tray including one or more arms including engagement members. The product display tray can also include a base having one or more tracks receiving the one or more arms, wherein the base is slidable along the one or more arms from a first position to a second position. The product display tray can also include a handle. The product display tray can also include a latch, wherein the latch is operably connected to the handle, wherein the latch has an engaged position and a disengaged position, and wherein the latch is in the engaged position when the base is in the first position and the base is operable to enter the second position when the latch is in the disengaged position.

International Application Publication No. WO 2018/200997 discloses a product display comprising a rail having a channel and a tray. The tray comprising a first sidewall, a second sidewall, and a product support surface. The tray further comprising an engagement portion having at least one protrusion configured to engage the channel.

The above-noted patents and patent application publications are hereby incorporated by reference herein in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example, a product display merchandiser comprises a tray having a product supporting surface; a first sidewall adjacent a first side of the tray; a second sidewall adjacent a second side of the tray; and a bracket configured to detachably mount the product display merchandiser to a support. The product display merchandiser is further configured with at least one of the following: the first and second sidewalls each having a respective sidewall vertical portion with a rear edge that is angled away from a rear of the product display merchandiser; the bracket having a tray-supporting portion that is oriented at an acute angle with respect to a support-engaging portion; and/or the bracket having at least two types of engagement members for mounting the product display merchandiser to either of at least two types of supports.

According to another example, a product display merchandiser comprises a tray having a product supporting surface; a first sidewall adjacent a first side of the tray; a second sidewall adjacent a second side of the tray; and a bracket having at least one upward hook configured to detachably mount the product display merchandiser to a pegwall. The product display merchandiser is further configured with at least one of the following in order to facilitate mounting of the product display merchandiser to the pegwall: the first and second sidewalls each having a respective sidewall vertical portion with a rear edge that is angled away from a rear of the product display merchandiser; and/or the bracket having a tray-supporting portion that is oriented at an acute angle with respect to a pegwall-engaging portion.

BRIEF DESCRIPTION OF THE DRAWINGS

Examples of pusher tray systems are described with reference to the following Figures. The same numbers are used throughout the Figures to reference like features and like components.

DETAILED DESCRIPTION

In the present description, certain terms have been used for brevity, clarity, and understanding. No unnecessary limitations are to be implied therefrom beyond the requirement of the prior art because such terms are used for descriptive purposes only and are intended to be broadly construed.

Product displays, such as merchandisers, are frequently used in retail environments to display products for sale. It is advantageous for these product displays to be configured to provide consumers easy access to the displayed product and to facilitate easy reloading by store employees. In addition to ease of use considerations, manufacturers of product displays seek to minimize materials and manufacturing costs associated with the product displays.

One problem with conventional merchandisers is that they typically have to be suspended from one of a bar, grid, or gondola rear wall. As such, in order to install tray merchandisers, a store must replace their existing displays or gondolas with one designed to support trays, such as a wire grid. Alternatively, the store must purchase tray merchandisers specialized to mount to their specific existing structures. This creates additional costs for the store to change displays, as well as creates additional costs for the manufacturer, who must manufacture a variety of different trays having different mounting structures to fit different applications.

Accordingly, the present inventors have determined that a need exists for improved product display merchandisers that are not only easy to use for both consumers and store associates, but also minimally expensive to produce, and which offer improved features and functions over conventional merchandisers. The present disclosure is of a rear attachment mechanism for mounting pusher trays to pegwalls or slatwalls where one would previously find, for example, pegs, hooks, baskets, or signage mounted, but not pusher tray systems. Prior pusher tray mounting systems require a mounting apparatus, such as a grid, to which the pusher tray would mount. Using the rear attachment mechanism of the present disclosure, a user can mount a pusher tray directly to commonly found existing wall structures in retail displays, such as pegwalls or slatwalls.

Figure 1:
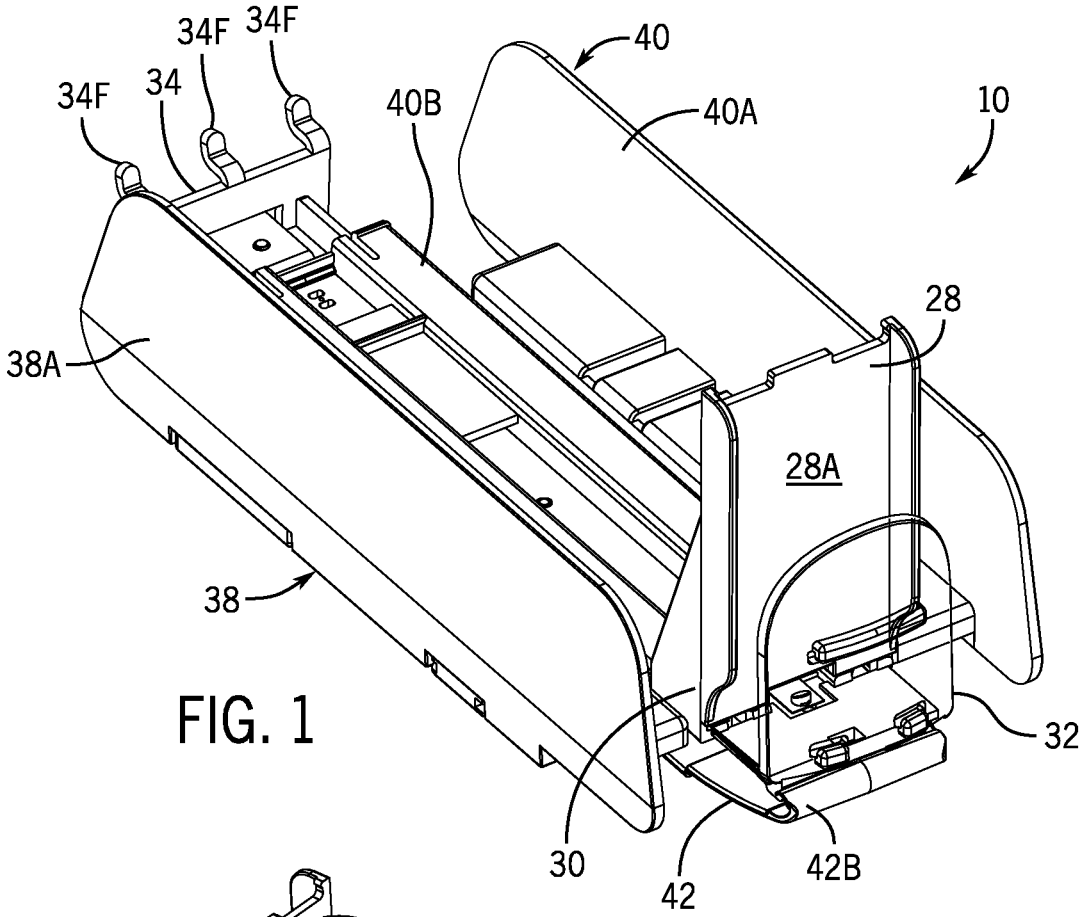
FIG. 1 illustrates a front perspective view of one example of a product display merchandiser according to the present disclosure.
Figure 2:
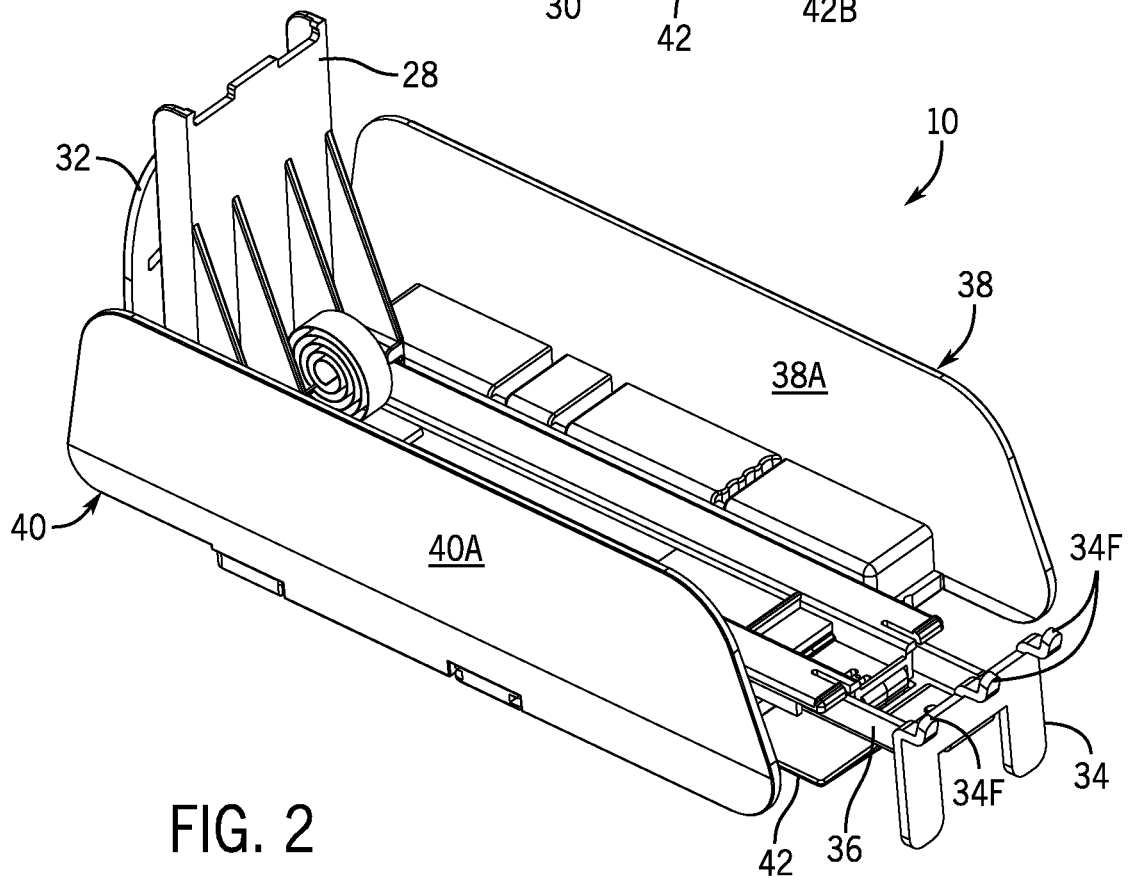
FIG. 2 illustrates a rear perspective view of the product display merchandiser.
Figure 3:
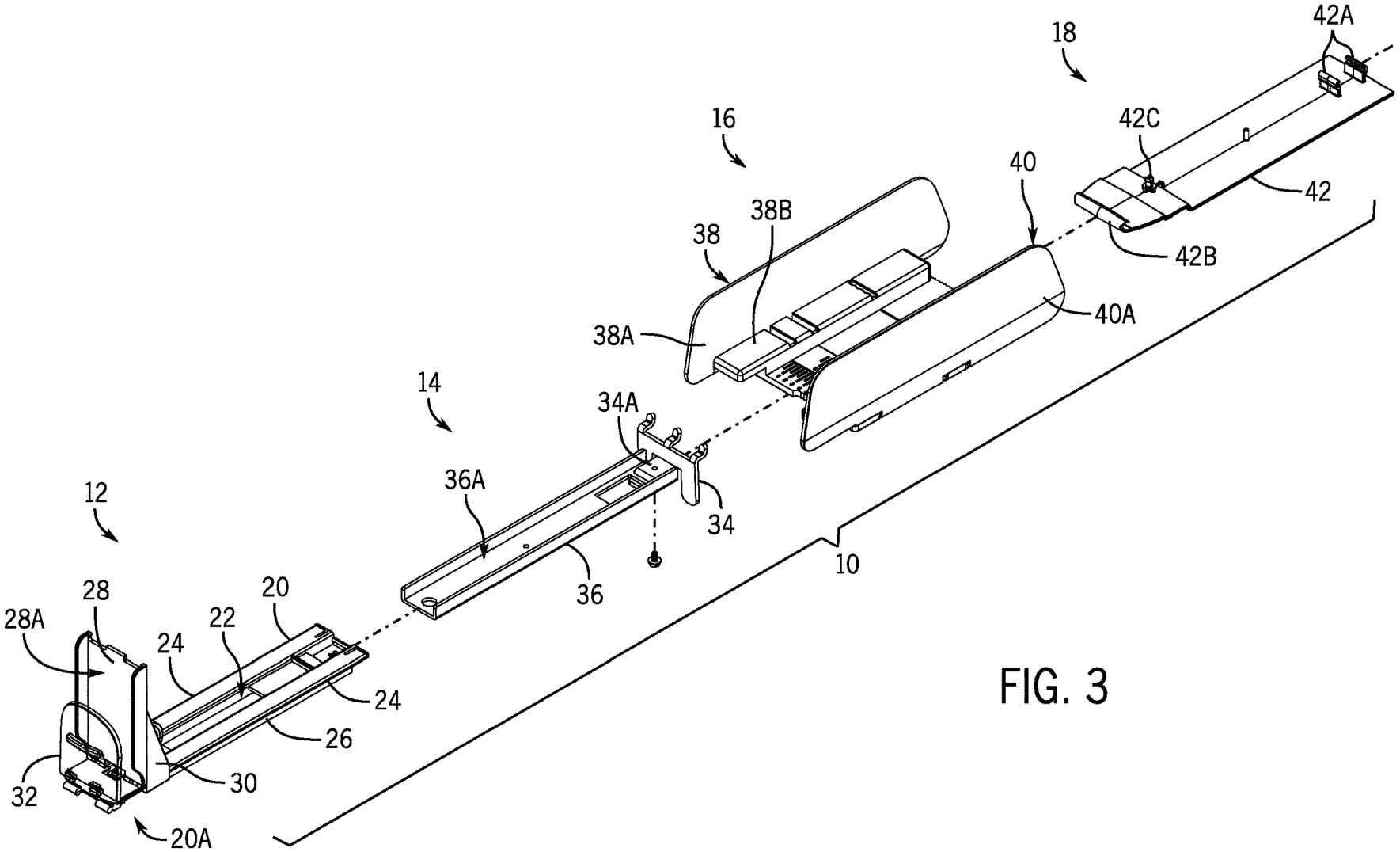
FIG. 3 illustrates a partially exploded view of the product display merchandiser.

FIGS. 1-3 illustrate a product display merchandiser 10 according to the present disclosure. Referring to FIG. 3, the product display merchandiser 10 is made up of four subassemblies, including a pusher subassembly 12, a support bracket subassembly 14, a sidewall subassembly 16, and a base subassembly 18. The pusher subassembly 12 includes a tray 20 having a rectangular channel 22 therein. On either lateral side of the tray 20 are slideways 24, which overhang supporting walls 26 on the underside of the tray 20. A pusher 28 has two sidewalls 30, the bottom ends of which are formed as inwardly-facing channels to receive the overhanging slideways 24 of the tray 20. The pusher 28 is slidable with respect to the tray 20, and a biasing member such as a spring (see 44, FIG. 4) is coiled behind the pusher 28, biasing the pusher 28 toward the front end 20*a* of the tray 20. A front lens 32 is positioned in front of the pusher 28, and is held to the front end 20*a* of the tray 20 by way of a snap fit, although other types of attachments could be used. Product is received on a front face 28*a* of the pusher 28, behind the front lens 32. As product is removed from the product display merchandiser 10, the pusher 28 slides toward the front end 20*a* of the tray 20. More specifically, when product is removed from between the pusher 28 and the front lens 32, the spring 44 forces the pusher 28 toward the front end 20*a* of the tray 20, and the channels at the bottom ends of pusher sidewalls 30 slide along slideways 24.

The support bracket subassembly 14 includes a bracket 34 and a support member 36. In this example, the support member 36 is C-shaped and has a channel 36*a* that opens upwardly; however, other structural cross-sections could be used. In this example, the bracket 34 is connected to the support member 36 by way of a more-or-less horizontally projecting tab 34*a* of the bracket 34, which tab 34*a* sits in the channel 36*a* and is bolted, riveted, or otherwise attached to the support member 36. In other examples, the bracket 34 and support member 36 could be a single, integral piece.

The sidewall subassembly 16 includes two sidewalls 38, 40, each of which includes a vertical portion 38*a*, 40*a* and a horizontal support surface 38*b*, 40*b* (FIG. 1). The support surfaces 38*b*, 40*b* overlap and interlock with one another to form a product-supporting surface of the product display merchandiser 10. A user can pull the vertical portions 38*a*, 40*a* toward one another or push the vertical portions 38*a*, 40*a* away from one another in order to accommodate products of differing widths.

The base subassembly 18 includes a plate 42 having retaining clips 42*a* at a rear end thereof and a socket 42*b* at a front end thereof. Another clip 42*c* projects from the upper surface of the plate 42 between the front and rear ends thereof. The clips 42*a*, 42*c* and socket 42*b* connect the base subassembly 18 to the remainder of the product display merchandiser 10, as will be described below.

Figure 4:
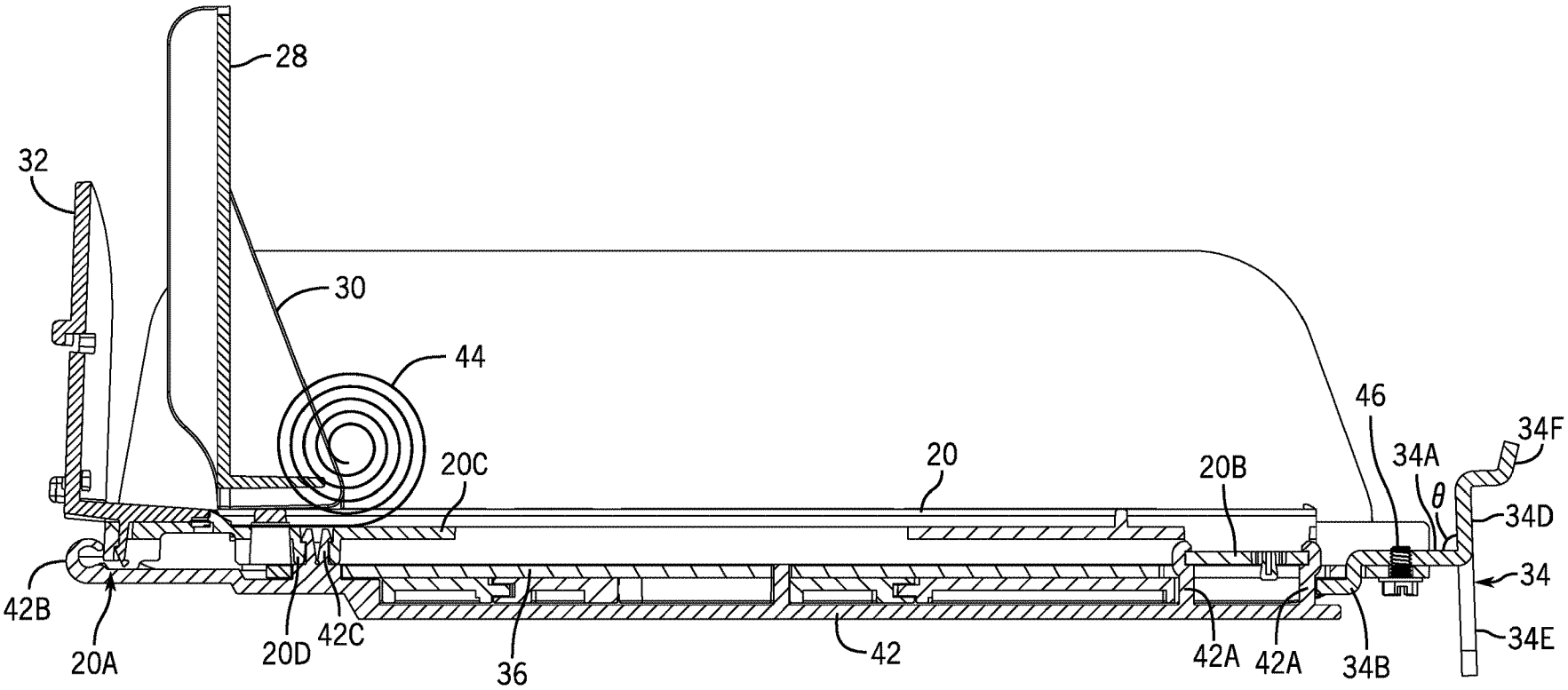
FIG. 4 is a cross-section of the product display merchandiser down a longitudinal centerline thereof.

FIG. 4 illustrates a cross-section of the product display merchandiser 10 down a longitudinal centerline thereof. The sidewall subassembly 16 is removed such that the interconnection of the pusher subassembly 12, support bracket subassembly 14, and base subassembly 18 can be seen. Additionally, this view shows the spring 44 that biases the pusher 28 toward the front end 20*a* of the tray 20.

The plate 42 is snap-fit to the tray 20 by way of the clips 42*a* extending through openings in the support member 36 and fitting around either end of a lower wall 20*b* of the tray 20. Clip 42*c* extends through an opening in the support member 36 and fits into a receiving boss 20*d* in lower wall 20*c* of tray 20. Clips 42*a*, 42*c* thereby connect the base subassembly 18 to the support bracket subassembly 14 and the pusher subassembly 12. Socket 42*b* receives a fitting (not shown) on the front end 20*a* of tray 20, also connecting the base subassembly 18 to the pusher subassembly 12. Tab 34*a* on bracket 34 includes a stepped portion 34*b* that fits through a gap (not shown) in the tray 20 in order to extend thereunder. A front end of the stepped portion 34*b* abuts the rearmost clip 42*a*. Support member 36 is attached to bracket 34 by way of bolt 46.

Figure 5:
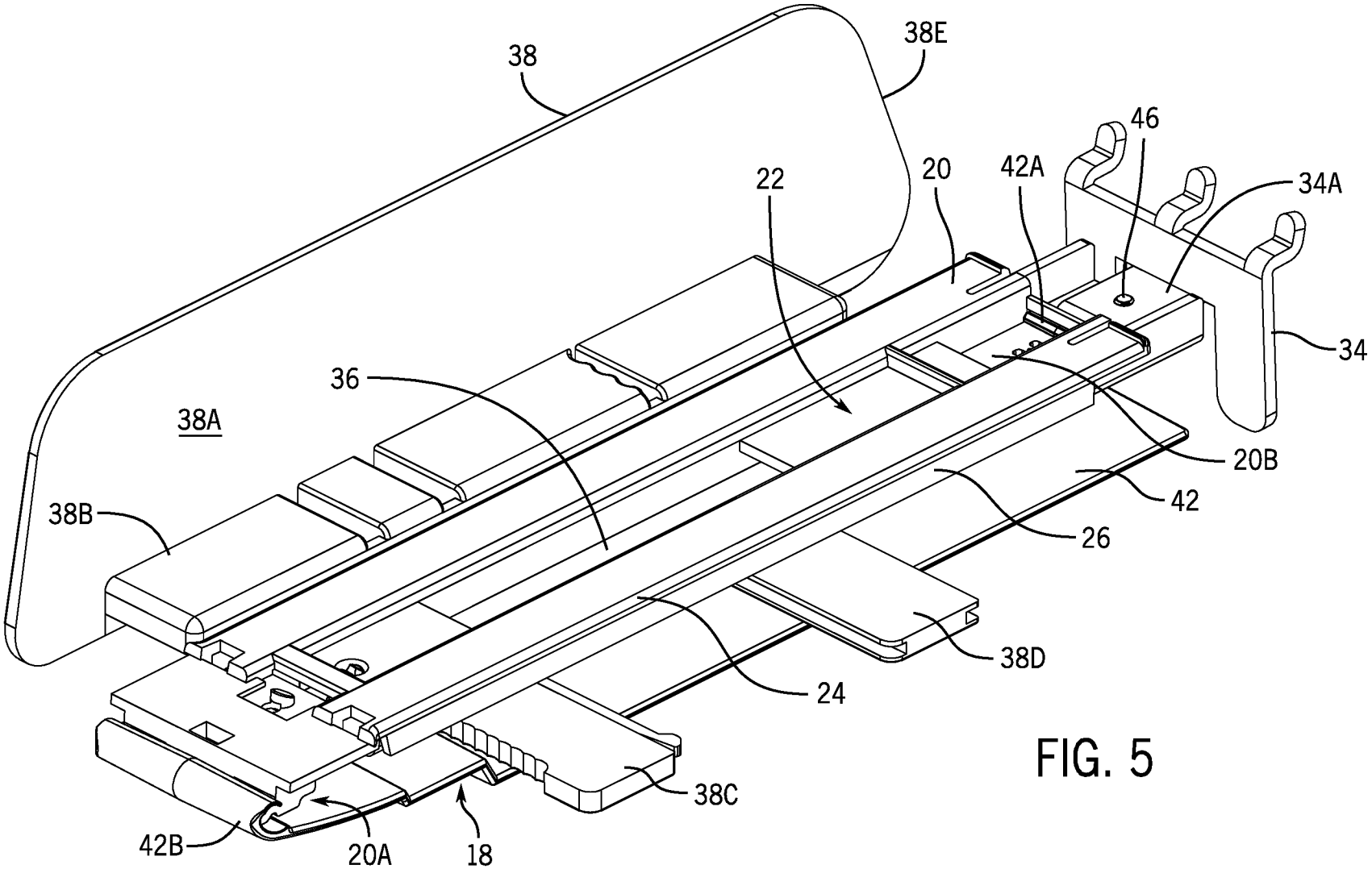
FIG. 5 is a partially assembled view of the product display merchandiser.
Figure 6:
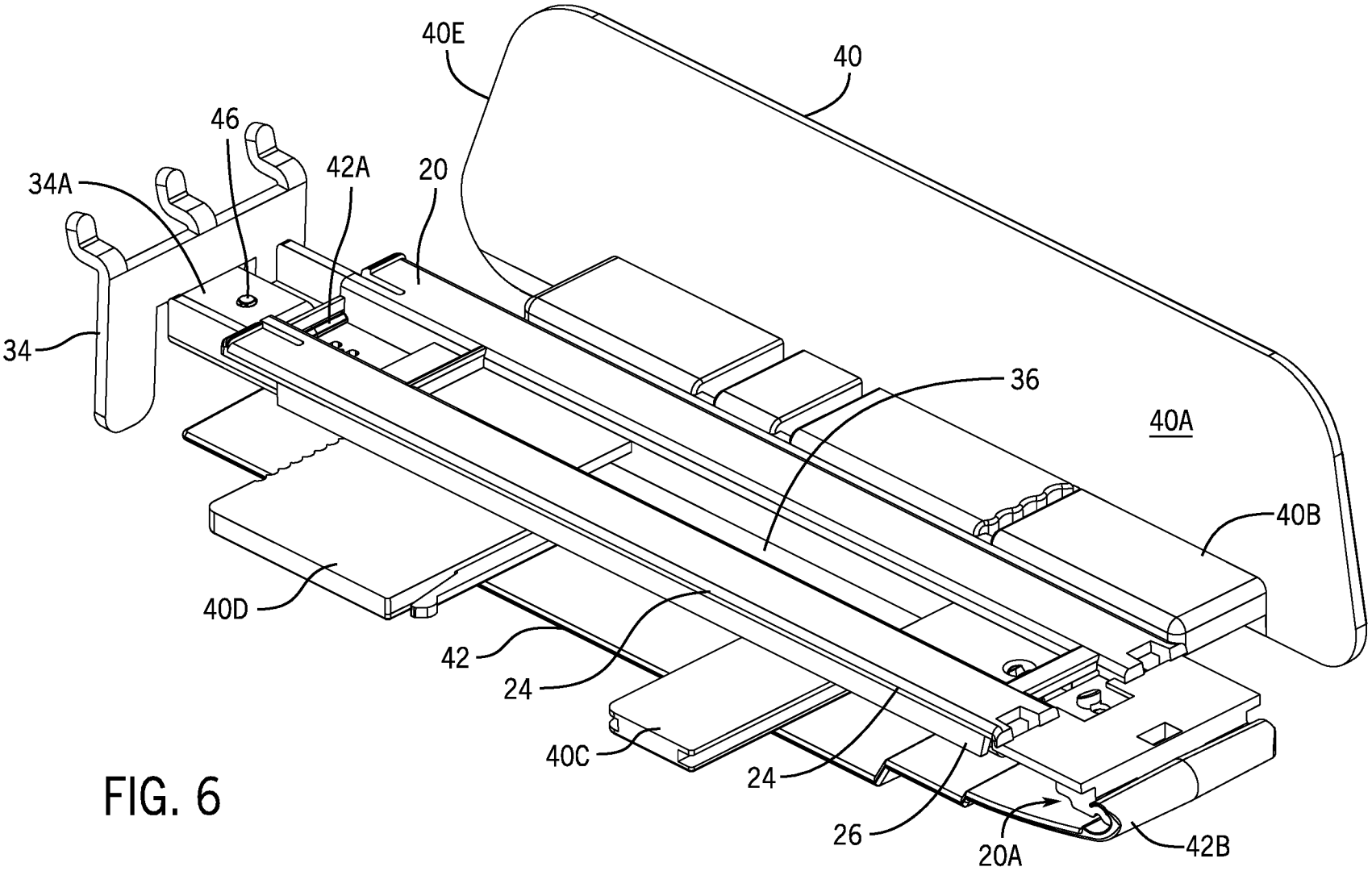
FIG. 6 is another partially assembled view of the product display merchandiser.

FIG. 5 shows a portion of the product display merchandiser 10 from which the front lens 32, pusher 28, and one of the sidewalls 40 has been removed. The sidewall 38 is installed to the base subassembly 18 and tray 20 by insertion of tabs 38*c*, 38*d* extending horizontally from support surface 38*b* between tray 20 and support member 36 on the upper side and plate 42 on the lower side. FIG. 6 shows the opposite sidewall 40, which also has tabs 40*c*, 40*d* extending horizontally from support surface 40*b*. Tabs 40*c*, 40*d* extend between tray 20 and support member 36 on the upper side and plate 42 on the lower side. Tabs 38*c*, 38*d*, 40*c*, 40*d* engage with one another in a puzzle-like fashion and allow the sidewalls 38, 40 to slide toward and away from one another and with respect to the base subassembly 18 while remaining connected to one another and to the base subassembly 18.

As noted herein above, current pusher tray assemblies include brackets configured for connection to a grid system. See, for example, U.S. Pat. Nos. 5,769,248 and 5,855,283, incorporated by reference herein above. Because these pusher tray assemblies require a grid system to hold them, an installment in a store requires room for a grid system and the attendant costs of purchasing and installing the grid system. These existing brackets do not allow for connection of the pusher tray assemblies to existing structures found in stores. For instance, in convenience stores, pegwalls or slatwalls may already be installed. The product display merchandiser 10 of the present disclosure can be supported by such pegwalls or slatwalls by way of the support bracket subassembly 14 of the present disclosure.

Figure 7:
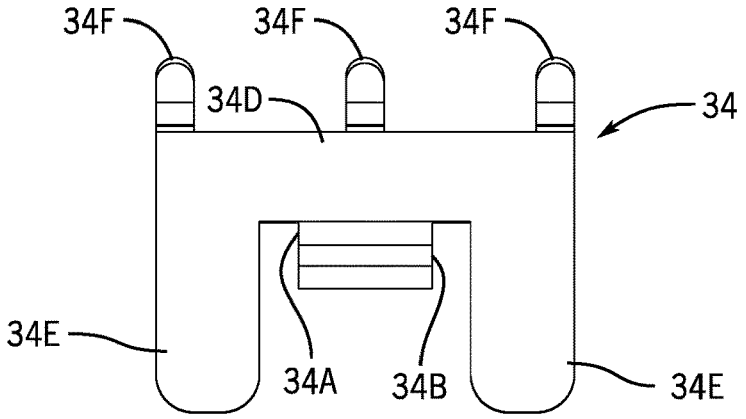
FIG. 7 illustrates a front view of a portion of the product display merchandiser of FIGS. 1-6.

FIG. 7 shows a rear view of the bracket 34 of the support bracket subassembly 14. The bracket 34 includes the above-mentioned tab 34*a* and stepped portion 34*b*. The tab 34*a* projects forwardly from a horizontal cross-member 34*d*, which connects two vertically extending legs 34*e*. Hooks 34*f* extend from the top of cross-member 34*d*. Hooks 34*f* are shown with one-inch spacing in order to fit into common one-inch spaced holes in a pegwall. However, other spacing between hooks 34*f* could be provided to match other common spacing of holes on pegwalls. Additionally, although three hooks 34*f* are shown, the bracket 34 need only have two hooks 34*f* for lateral stability, or could have more than three hooks 34*f*. The two or more hooks 34*f* extend beyond the rear of the pusher subassembly 12, sidewall subassembly 16, and base subassembly 18 so as to allow the product display merchandiser 10 to connect to a pegwall or slatwall, and in some instances so as to aid in allowing the product display merchandiser 10 to pivot into a holding position on the pegwall or slatwall. In another example, the bracket 34 is flush with or almost flush with the rear of the pusher subassembly 12, sidewall subassembly 16, and base subassembly 18.

Figure 8:
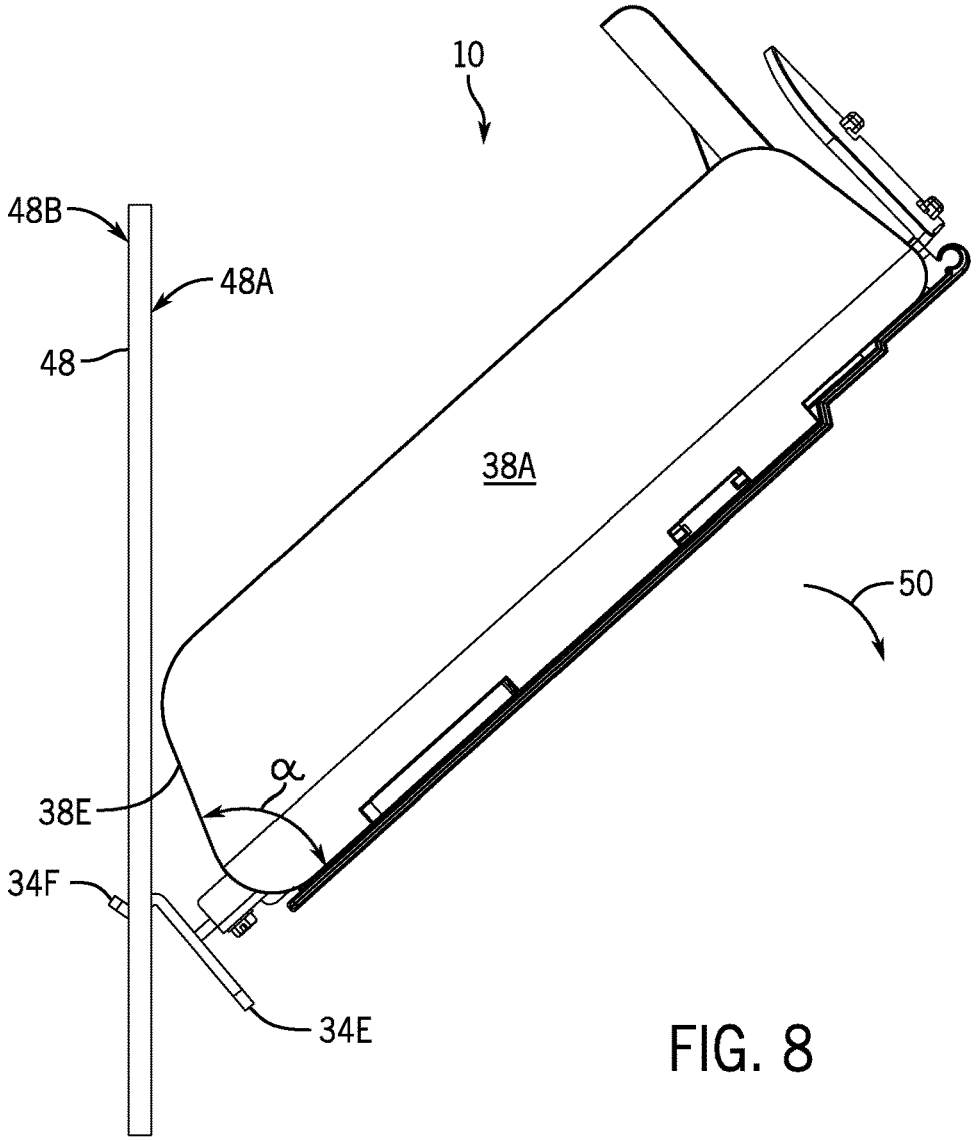
FIG. 8 illustrates the product display merchandiser in process of being installed on a pegwall.
Figure 9:
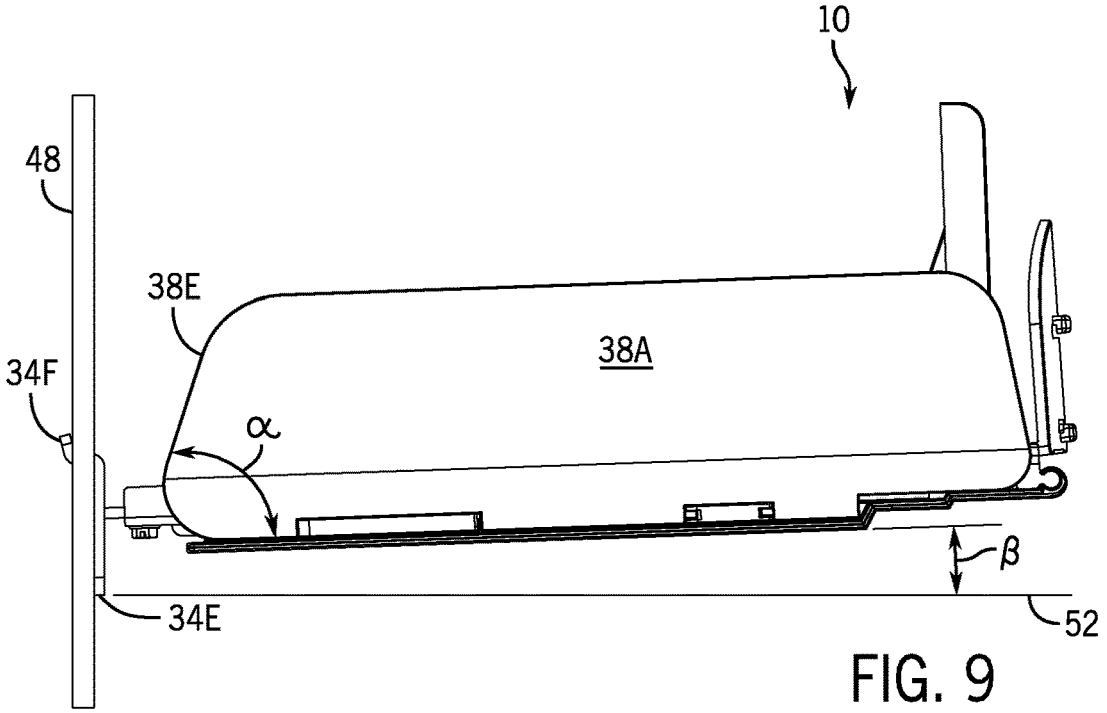
FIG. 9 illustrates the product display merchandiser in an installed position on the pegwall.

As can be seen in FIGS. 1 and 2, the hooks 34*f* are bent backwards such that they can be inserted into peg holes in a pegwall 48 (FIG. 8), after which front faces of their upper ends will face a back surface 48*b* of the pegwall 48 (FIG. 9). In order to insert the hooks 34*f* into the peg holes in the pegwall 48, as shown in FIG. 8, the product display merchandiser 10 must be tilted upwardly toward the vertically oriented pegwall 48. Once the hooks 34*f* are in the holes, the product display merchandiser 10 can then be rotated downwardly in the direction of arrow 50 until the rear surfaces of cross-member 34*d* and legs 34*e* rest against the front face 48*a* of the pegwall 48 (FIG. 9).

Returning to FIG. 8, in order to allow the product display merchandiser 10 to be tilted such that the hooks 34*f* can fit into the peg holes in the pegwall 48, the sidewall vertical portions 38*a*, 40*a* have rear edges 38*e*, 40*e* that are angled away from the rear of the product display merchandiser 10. In other words, the rear edges 38*e*, 40*e* of the vertical portions 38*a*, 40*a* are not squared-off, but rather an acute angle $\alpha$ is formed between the bottom edge of each vertical portion 38*a*, 40*a* and the rear edge 38*e*, 40*e* of each vertical portion 38*a*, 40*a*. Such a design provides clearance for the pivoting motion needed for mounting and un-mounting the product display merchandiser 10 to the pegwall 48.

FIG. 9 shows the product display merchandiser 10 installed (mounted) on the pegwall 48. It can be seen that in an unloaded state, the product display merchandiser 10 is designed to angle upwardly from the horizontal 52 by an angle $\beta$. This angle $\beta$ is created by virtue of the design of the bracket 34, of which the tab 34*a* is not perfectly perpendicular to the cross-member 34*d* and legs 34*e*, but rather angled upwardly with respect thereto. In one example, $\beta$ is between 1.5 and 3 degrees. In a specific example, $\beta$ is 2 degrees. When the product display merchandiser 10 deforms after mounting, due to its own weight and due to flexibility of the pegwall 48, the product display merchandiser 10 settles at a near parallel angle with the ground. If the bracket 34 did not include the angle $\beta$, the product display merchandiser 10 would lean past parallel with the ground and might be unsightly or perceived as having low quality.

Figure 10:
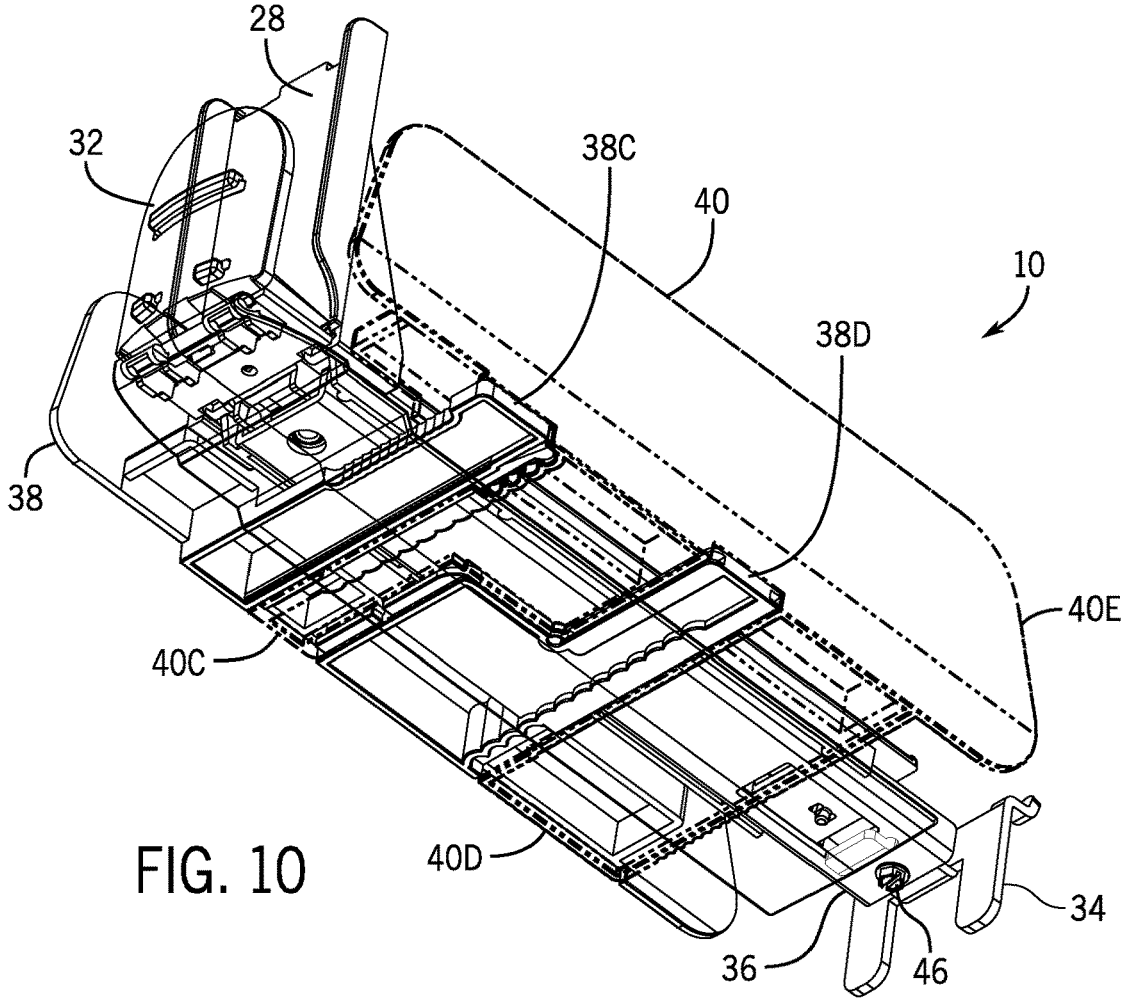
FIG. 10 illustrates a bottom perspective view of the product display merchandiser.

As shown in FIG. 10, the support member 36 further transfers the load of the product display merchandiser 10 to the mounting location on the pegwall 48 and keeps the product display merchandiser 10 from deforming downward an undesirable amount, even when loaded with product. Although the support member 36 is shown herein as extending almost the full length of the product display merchandiser 10, it could be longer or shorter than that shown herein. Additionally, as mentioned herein above, although the support member 36 is shown as being bolted to the bracket 34, these parts could be integral or attached in other known manners. In another example, the support member 36 could be part of the pusher subassembly 12, such as integral with the tray 20. In another example, the support member 36 could be part of the base subassembly 18, such as integral with the plate 42. The support member 36 could be made of metal or rigid plastic.

Note that FIG. 10 also shows how the tabs 38*c*, 38*d*, 40*c*, 40*d* of the sidewall subassembly 16 fit together in an interlocking fashion. As noted herein above, the tabs 38*c*, 38*d*, 40*c*, 40*d* are slidable with respect to one another and are inserted between the tray 20 and support member 36 on their upper side and the plate 42 on their lower side.

The product display merchandiser 10 of the present disclosure is therefore attachable to a pegwall or slatwall, and is designed with several features, including sidewalls 38, 40 having angled rear edges, an upwardly angled bracket 34, and a support member 36 that accommodate such mounting to a pegwall or slatwall.

Figure 11:
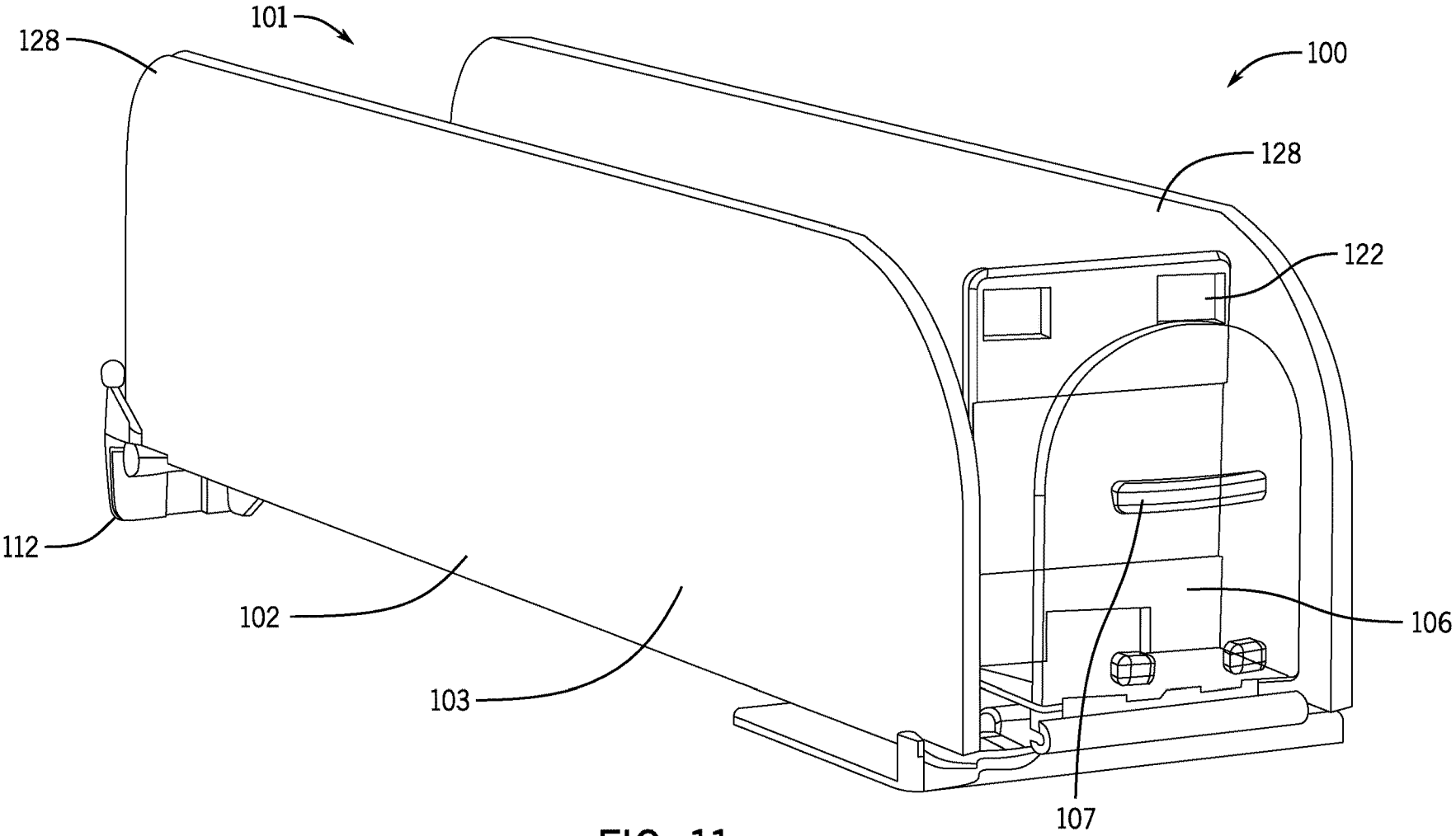
FIG. 11 is a perspective view of a product display merchandiser according to another example of the present disclosure, taken from above and in front of the merchandiser and illustrating an exemplary fixed width design, the product display merchandiser having a rear mounting structure configured to mount to a plurality of shelving systems.

FIG. 11 illustrates another example of a product display merchandiser 100 according to the present disclosure. The product display merchandiser 100 includes a tray 102 for holding a product to be displayed. The tray 102 includes a pair of sidewalls 128 and a product supporting surface 103 which together form a product channel 101. In operation, a plurality of products is loaded into the tray 102 such that the products form a row in the product channel 101.

A pusher 122 is slidable relative to the product supporting surface 103. The pusher 122 is biased towards the front of the tray 102, or towards the front lens 106. In some forms, the pusher 122 is biased by a spring, such as a coil spring. Alternatively, the tray 102 may be slanted with the front end lower than the rear end, and the pusher 122 weighted so as to be biased by gravity. As products are removed from the channel 101, the pusher 122 pushes the row forward so as to automatically face the products. The front lens 106 forms a product stop to prevent the front-most product from falling off of the tray 102 as a result of the pushing. The front lens 106 includes a price channel or indicia holder 107. The indicia holder 107 comprises one or more forward protrusions having a channel therein configured to receive a removable indicia, such as a price card. In a preferred form, the front lens 106 is substantially transparent or translucent to allow a shopper to view the product in the tray 102. As shown, in some forms, the sidewalls 128 are at least partially transparent or translucent to further increase visibility of the product.

Figure 15:
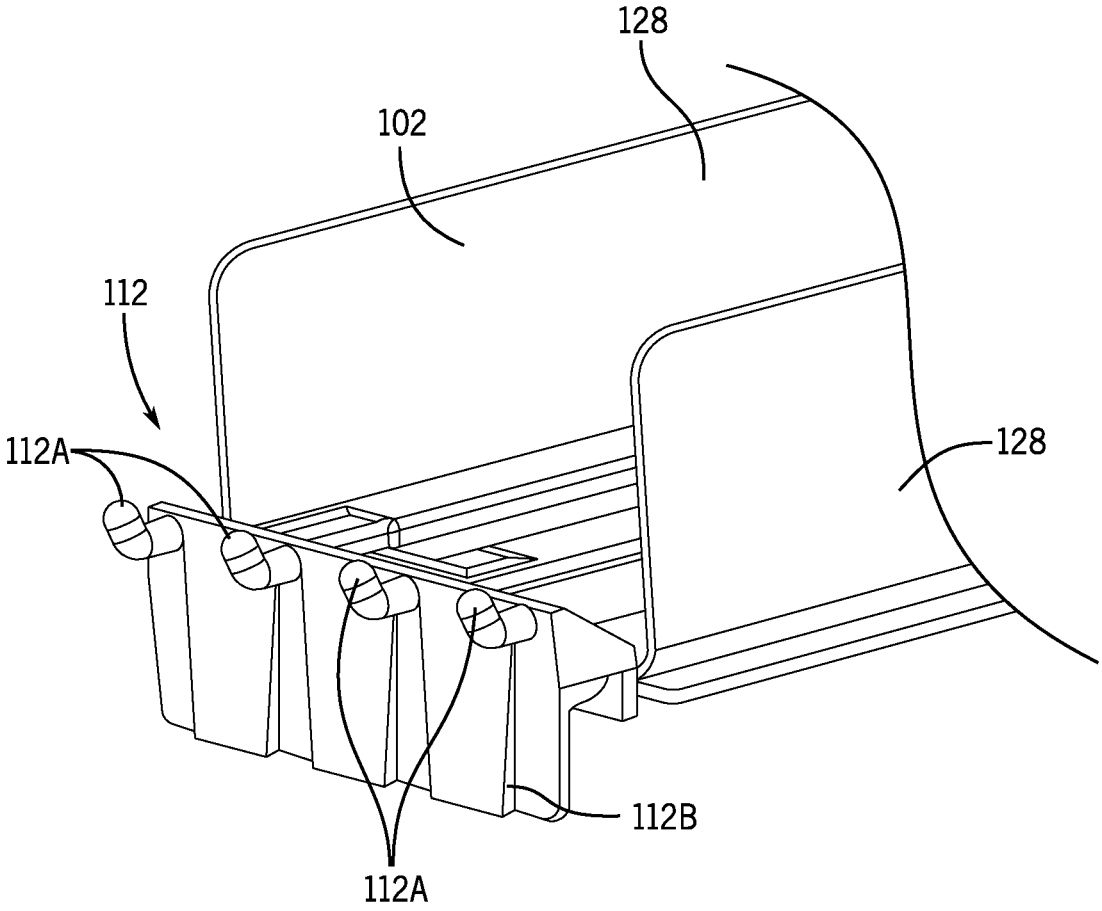
FIG. 15 is a top rear perspective view of the rear of a product display merchandiser having a rear mounting structure like that of the merchandisers of FIGS. 11 and 12-14.
Figure 16:
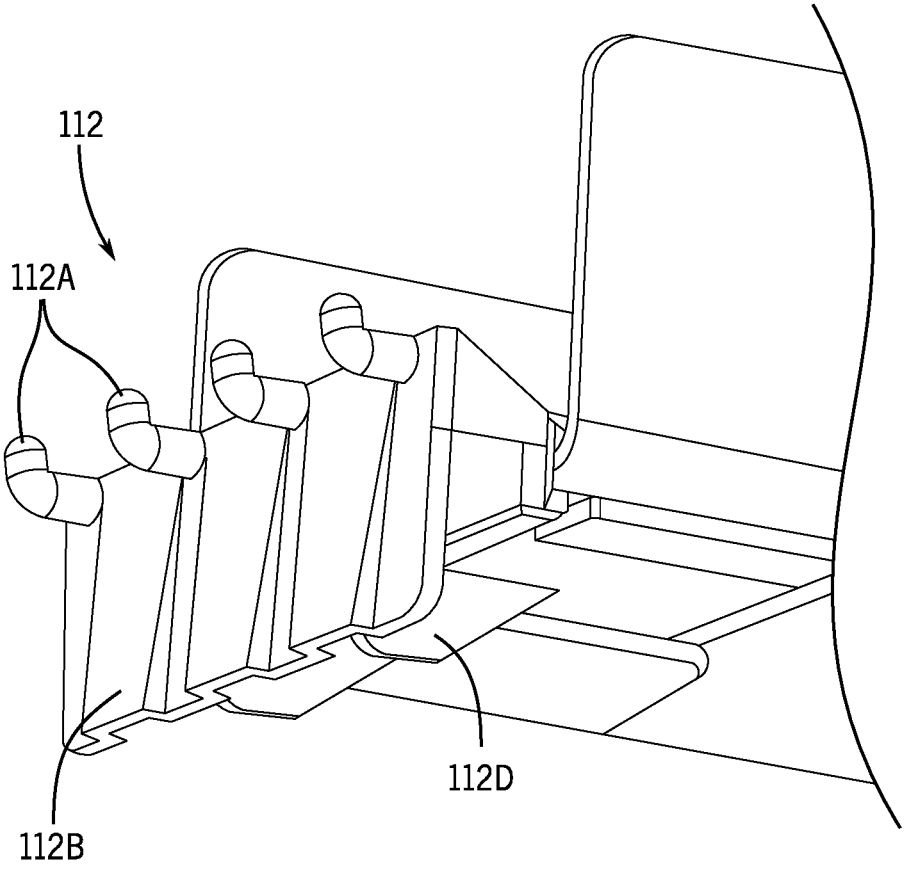
FIG. 16 is bottom rear perspective view of the rear of the product display merchandiser of FIG. 15.
Figure 17:
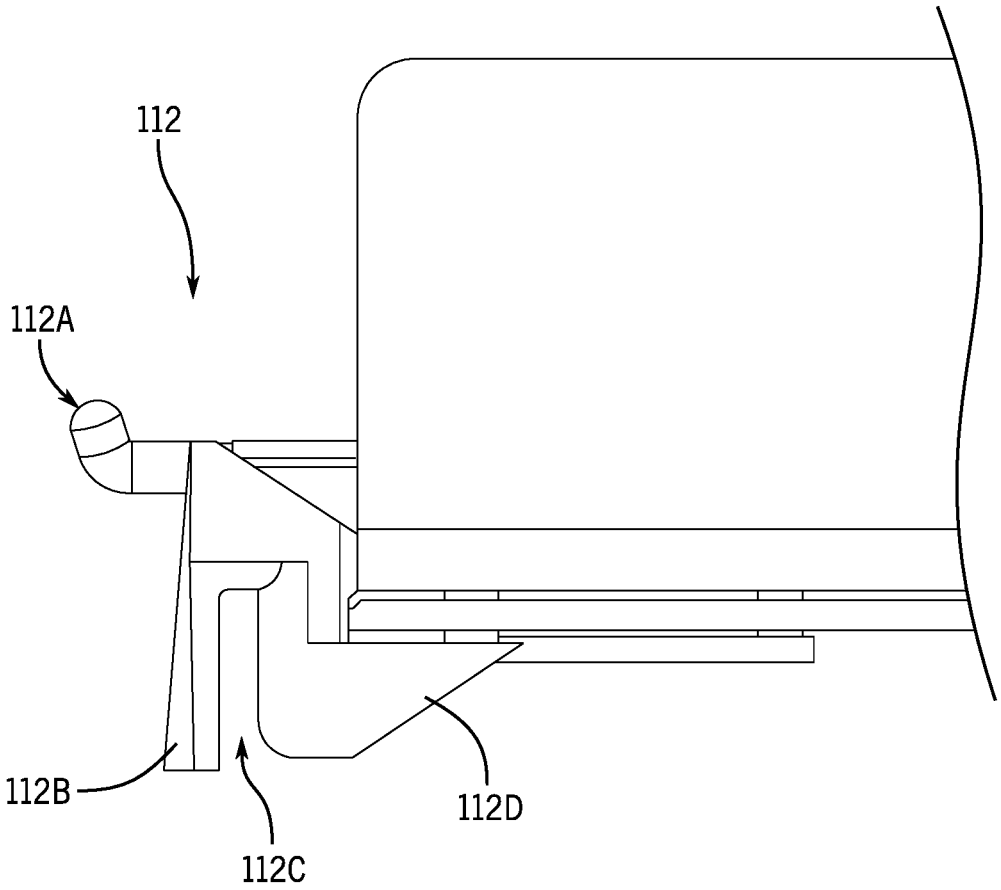
FIG. 17 is a side elevational view of the rear of the product display merchandiser of FIGS. 15 and 16.

The merchandiser 100 includes a rear mounting bracket 112. As shown in FIGS. 15-17, the bracket 112 has a plurality of differently shaped engagement members 112*a*-112*d* for engaging different types of styles of supports found on common shelving units, wall units, gondolas, or other vertical product displays. The first type of engagement member is an upward hook 112*a*. The upward hook 112*a* comprises a rearward projection that extends rearward for a first section and then angles upward for a second section such that the second section is at an oblique angle less than 90 degrees upward from the horizontal, when measured in a clockwise direction.

The bracket 112 includes a plurality of upward hooks 112*a* spaced across the width of the bracket 112. The upward hooks 112*a* are configured to mount the merchandiser 100 to a pegwall, such as the pegwall 48 of FIG. 18. The pegwall 48 has a plurality of spaced holes 49 arranged in rows and columns. To install the merchandiser 100 on the pegwall 48, the front of the merchandiser 100 is tilted upward until the upward extending portions of the hooks 112*a* are substantially horizontal. The merchandiser 100 is then shifted backwards such that the hooks 112*a* extend at least partially through the holes 49 of the pegwall 48. Tilting the merchandiser 100 back down to its horizontal position causes an interference engagement between the hooks 112*a* and a back surface of the pegwall 48, restricting removal of the bracket 112 from the pegwall 48. A second engagement member (rear flange 112*b*) rests along a front surface of the pegwall 48, holding the merchandiser 100 in a substantially horizontal position (or in the instance of gravity biased merchandisers described above, at a predetermined angle).

The hooks 112*a* are spaced and sized to interact with standard sized pegwalls. In one example, the hooks 112*a* are spaced apart by distances evenly divisible by 1 inch. For example, a hook 112*a* is positioned every 1 inch, every 2 inches, every 3 inches, or every 4 inches across the width of the bracket 112. The hooks 112*a* may have a diameter of approximately ¼ inch. The ¼ inch hooks 112*a* are configured to be received in a pegwall 48 having holes 49 having a diameter of approximately ¼ inch to 9/16 inch. In alternative forms, differently sized and/or spaced hooks 112*a* are used to mount on differently sized pegwalls. For example, the hooks 112*a* may be spaced in ½ inch increments (or multiples thereof) and may have a diameter of approximately ⅛ inch.

Figure 19:
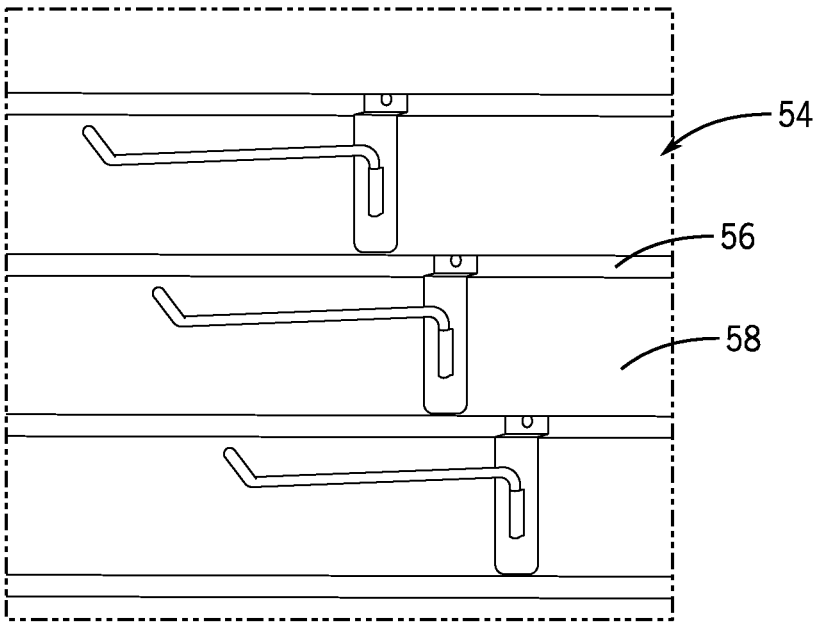

The hooks 112*a* and rear flange 112*b* similarly work together to mount the merchandiser 100 to a slotwall or slatwall, such as the slatwall 54 of FIG. 19. The slatwall 54 has a plurality of horizontal channels 56 defining horizontal slats 58. The channels 56 are taller at the rear than at the front, so as to extend upward behind a portion of the slats 58. To install the merchandiser 100 on the slatwall 54, the merchandiser 100 is tilted backward as described above, until the upward portions of the hooks 112*a* are substantially horizontal. The hooks 112*a* are passed into a given channel 56, after which the front of the merchandiser 100 is lowered back to a horizontal position. In this position, the hooks 112*a* and a rear surface of a slat 58 above the given channel 56 form an interference engagement, resisting removal of the merchandiser 100 from the slatwall 54. The rear flange 112*b* of the bracket 112 rests against the front surface of a slat 58 below the given channel 56, holding the merchandiser 100 at the desired angle, such as horizontal.

When mounted to either the pegwall 48 or slatwall 54, removal of the merchandiser 100 is achieved by reversing the steps above. The front end of the merchandiser 100 is lifted until the upper portions of the hooks 112*a* are substantially horizontal. The merchandiser 100 is then pulled forward to remove the hooks 112*a* from the holes 49 or channels 56.

Figure 20:
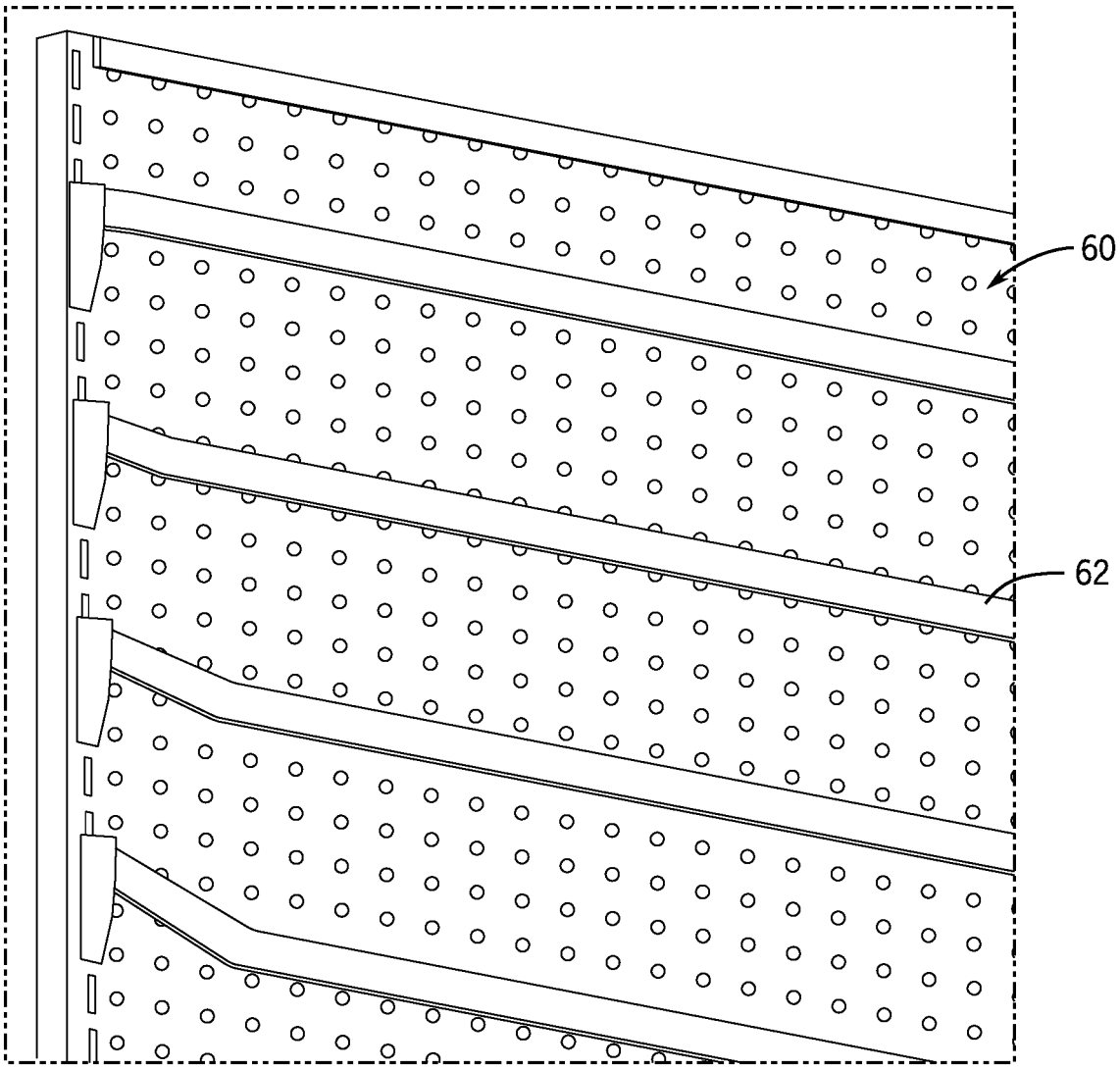

As shown in FIG. 17, the rear flange 112*b* and one or more downward projections or ribs 112*d* together define a downward facing channel 112*c*. The downward facing channel 112*c* is sized to receive a standard sized crossbar of a shelving unit. FIG. 20 illustrates a vertical shelving unit or gondola 60 having a plurality of horizontal crossbars 62. To install the merchandiser 100 on the gondola 60, the merchandiser 100 is lifted until the rear flange 112*b* is completely above a crossbar 62. The merchandiser 100 is then moved backward until the channel 112*c* aligns with the crossbar 62, after which the merchandiser 100 is lowered onto the crossbar 62. The crossbar 62 fits snugly within the channel 112*c*, supporting the merchandiser 100. The merchandiser 100 is removable from the crossbar 62 by lifting the merchandiser 100 vertically relative to the crossbar 62.

Figure 18:
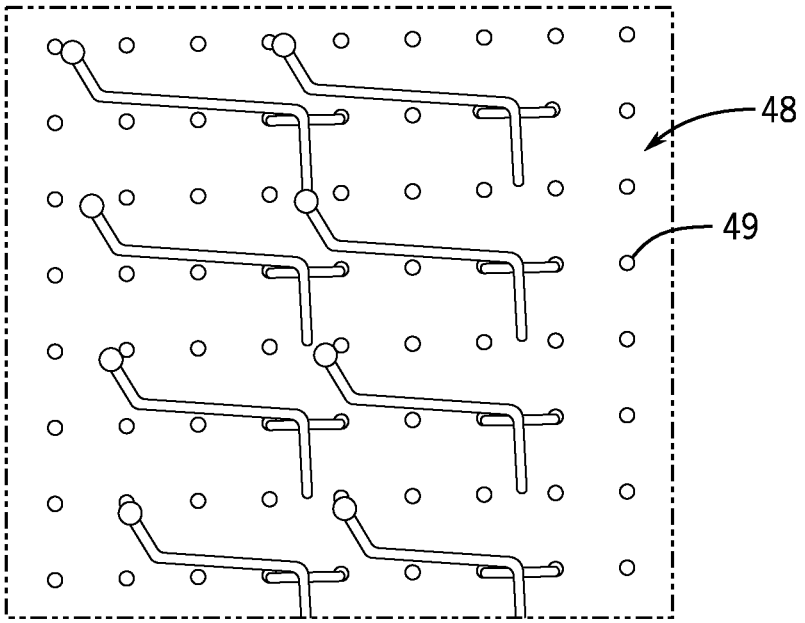
FIGS. 18-20 are perspective views of different prior art supports, display structures, or shelving structures to which the rear mounting structure of FIGS. 15-17 is configured to detachably mount.

While FIGS. 18-20 illustrate a relatively narrow channel 112*c*, it is understood that the channel 112*c* is sized to fit standard sized crossbars. The illustrated channel 112*c* is sized to fit the relatively narrow crossbars 62 shown in FIG. 20, also known as flat bars. In other embodiments, the channel 112*c* is wider and can mount onto wider crossbars, such as crossbars having a square or rectangular cross section. In alternative embodiments, one or both of the rear flange 112*b* and ribs 112*d* are slidable relative to each other (i.e., in a longitudinal direction of the merchandiser 100) so as to adjust the width of the channel 112*c*. In still further alternatives, the bracket 112 includes one or more clamping members, such as a threaded set screw or bolt, arranged within the channel 112*c* that can be used to clamp the bracket 112 onto crossbars 62 of varying sizes.

When mounted to either the slatwall 54 or crossbar 62, the merchandiser 100 is moveable in a horizontal direction. To adjust the merchandiser 100 along the slatwall 54, the front end of the merchandiser 100 is partially lifted to reduce friction between the hooks 112*a* and the rear surface of the upper slat 22 and between the rear flange 112*b* and the front surface of the lower slat 22. The merchandiser 100 can then be slid to the desired position along the channel 21. Similarly, to adjust the horizontal location of a merchandiser 100 along a crossbar 62, the merchandiser 100 is partially lifted to reduce friction between the bracket 112 and the crossbar 62. The lifted merchandiser 100 is then slid to the desired position along the crossbar 62. The horizontal position of a pegwall-mounted merchandiser 100 is also adjustable by removing the merchandiser 100 as described above, and mounting it to a different set of holes 49. By adjusting a plurality of merchandisers 100 both vertically and horizontally, a planogram can be customized to fit a wide array of products, such as shown in FIG. 2C.

Figure 12:
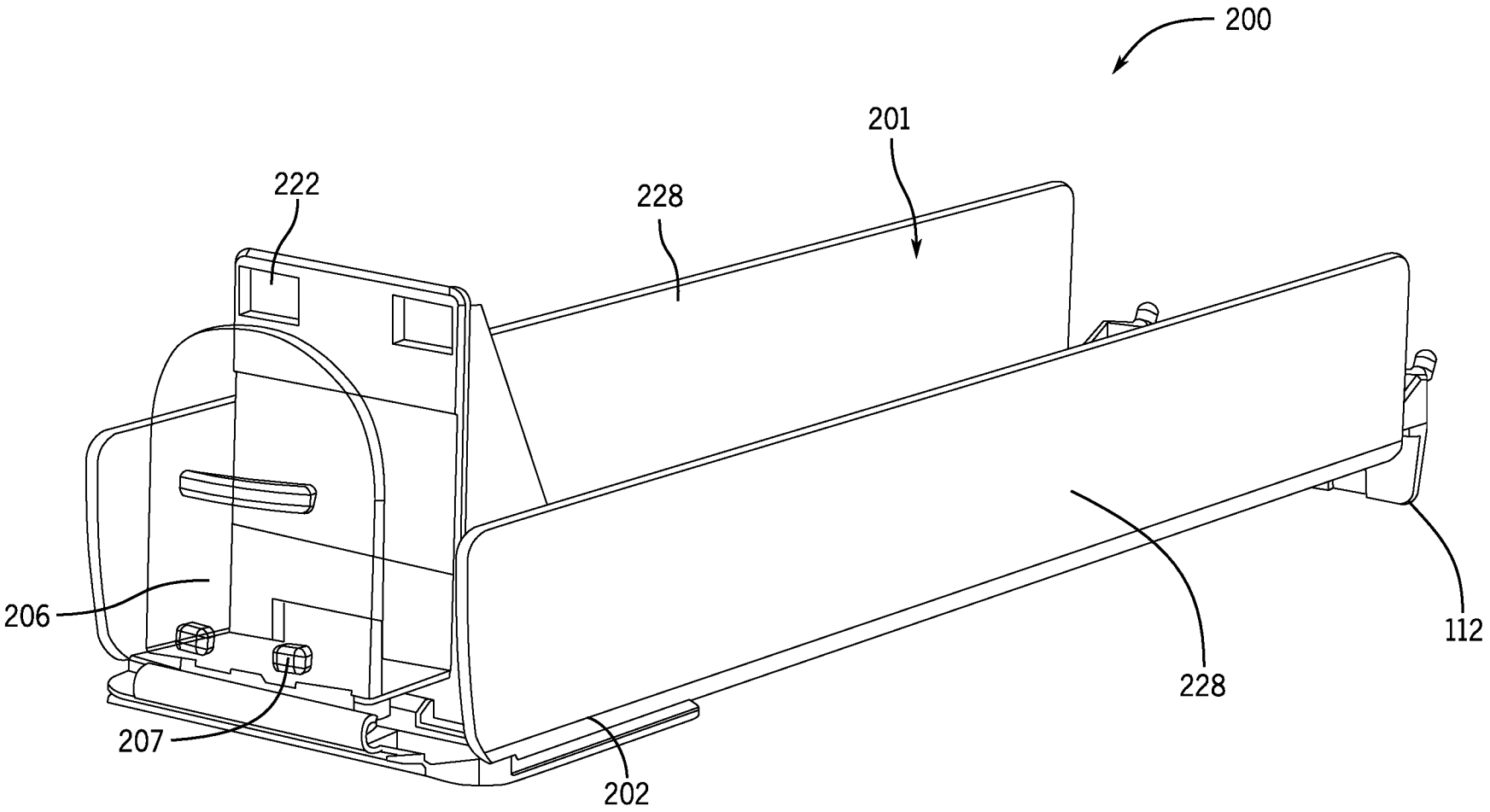
FIG. 12 is a perspective view of an alternate product display merchandiser having adjustable sidewalls moveable from a first, retracted position (as shown) to a second, extended position to adjust the width of the merchandiser, the product display merchandiser having a substantially similar rear mounting structure as that of the merchandiser of FIG. 11.
Figure 13:
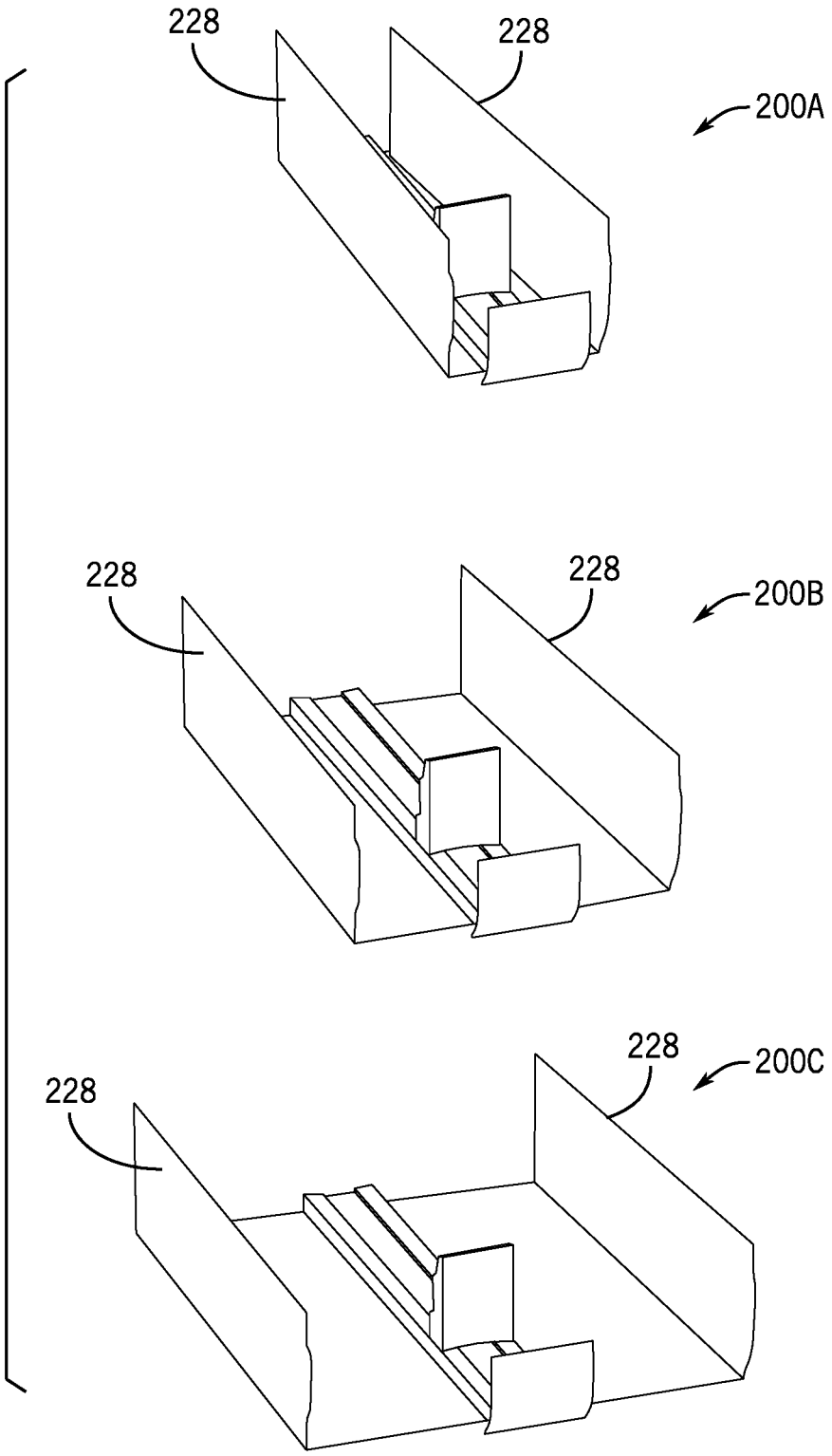
FIG. 13 illustrates a plurality of the merchandisers of FIG. 12 with the sidewalls in different positions.
Figure 14:
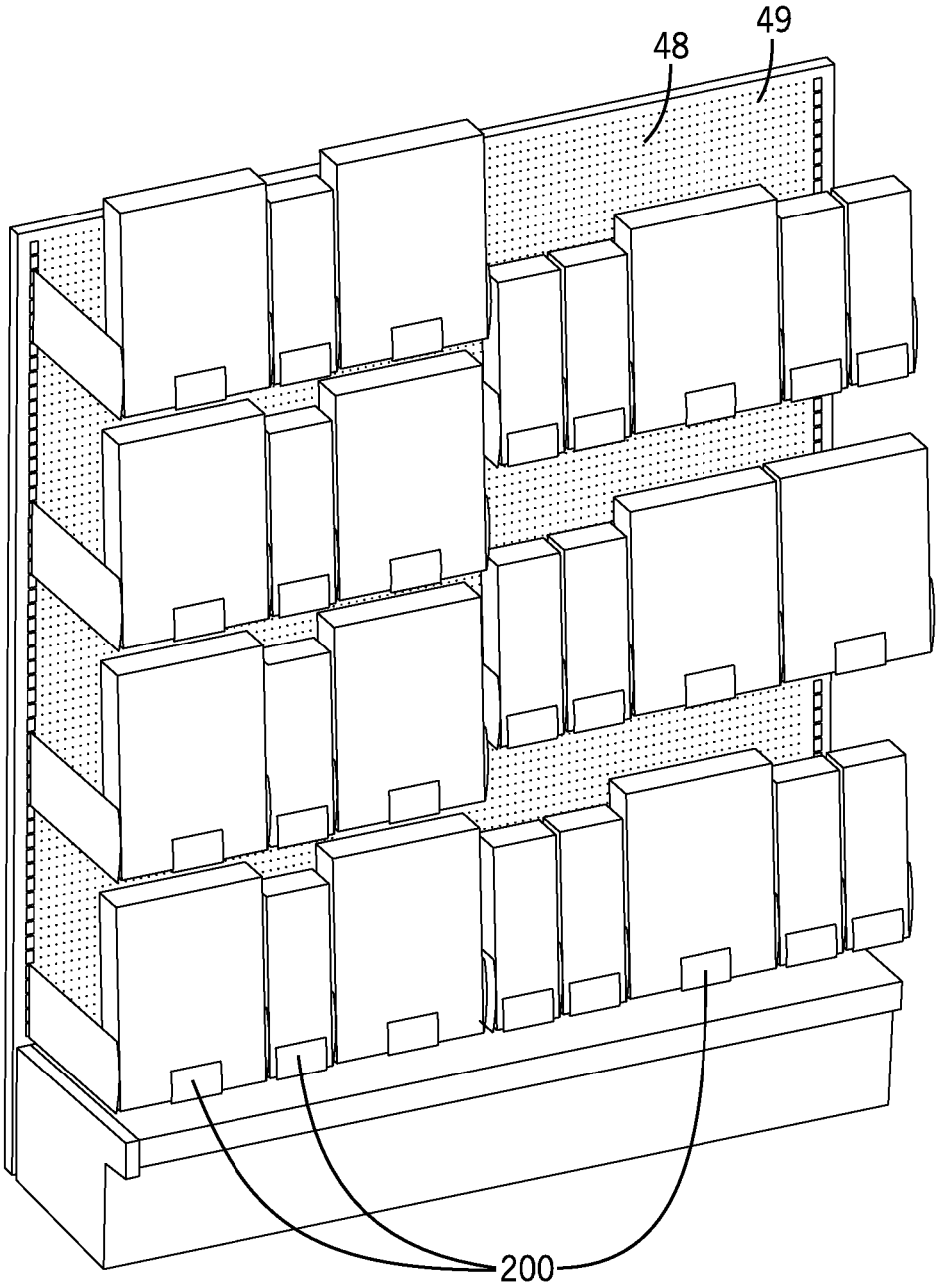
FIG. 14 is a planogram having a plurality of the merchandisers of FIGS. 12 and 13 with the sidewalls adjusted to display products of different widths.

FIGS. 12-14 illustrate a product display merchandiser 200 according to some forms of the present disclosure. The product display merchandiser 200 includes a tray 202 for holding a product to be displayed. The tray 202 includes a pair of sidewalls 228 and a product support surface (not shown) which together form a product channel 201. In operation, a plurality of products is loaded into the tray 102 such that the products form a row in the product channel 201.

A pusher 222 is slidable relative to the tray 202. The pusher 222 is biased towards the front of the tray 202, or towards the front lens 206. In some forms, the pusher 222 is biased by a spring, such as a coil spring. Alternatively, the tray 202 may be slanted with the front end lower than the rear end, and the pusher 222 weighted so as to be biased by gravity. As products are removed from the channel 201, the pusher 222 pushes the row forward so as to automatically face the products. The front lens 206 forms a product stop to prevent the front-most product from falling off of the tray 202 as a result of the pushing. The front lens 206 includes a price channel or indicia holder 207. The indicia holder 207 comprises one or more forward protrusions having a channel therein configured to receive a removable indicia, such as a price card. In a preferred form, the front lens 206 is substantially transparent or translucent to allow a shopper to view the product being displayed.

The merchandiser 200 includes a bracket 112 substantially similar to the bracket 112 described herein above. Therefore, the merchandiser 200 is configured to be mounted to a slatwall, pegwall, or horizontal bar as described herein above.

One or both of the sidewalls 228 of the merchandiser 200 are adjustable in a horizontal direction, or laterally with respect to the merchandiser 200. Specifically, the sidewalls 228 are moveable relative to the pusher 222 from a first, retracted position (as shown in FIG. 12), to a second, extended position (not shown), thereby widening the product channel 201. In a preferred form, the sidewalls 228 are also movable to a plurality of positions in between the fully retracted and fully extended positions, or are infinitely adjustable.

FIG. 13 illustrates a plurality of merchandisers 200*a*-200*c* with the sidewalls 228 in fully retracted positions (200*a*), partially extended positions (200*b*), and fully extended positions (200*c*), respectively. As can be seen, adjusting the width enables the merchandiser 200 to be customizable to display a variety of differently sized products. In addition to the symmetrical arrangements shown, each sidewall 228 is individually adjustable so as to provide more versatility and customizability.

FIG. 14 illustrates a planogram of a plurality of merchandisers 200 mounted to a pegwall 48. As shown, different merchandisers 200 have their respective sidewalls 228 at different positions to accommodate products of different widths. The merchandisers 200 of different width are arranged adjacent to one another to increase the horizontal loadout of the planogram. Additionally, the merchandisers 200 are mounted on different rows of holes 49 within the pegwall 48 in order to vertically stagger the merchandisers 200. Vertically staggering the merchandisers 200 allows for the planogram to include products of different heights while still maximizing vertical loadout.

In FIGS. 12-14, the sidewalls 228 are shown as solid plastic. In alternative embodiments, different materials are used to form the sidewalls 228, such as clear plastic as with the merchandiser 100 of FIG. 11. By way of another example, a merchandiser 200 with wire sidewalls is considered herein. Exemplary merchandisers with wire sidewalls are disclosed in U.S. Pat. No. 5,796,248, which is hereby incorporated by reference in its entirety.

Additionally or alternatively, in some forms the sidewalls 228 are removable from the tray 202. By removing the sidewalls 228, differently sized sidewalls 228 can be interchanged. The differently sized sidewalls 228 are used to customize the tray 202 to display a different size or different range of sizes of products.

Figure 21:
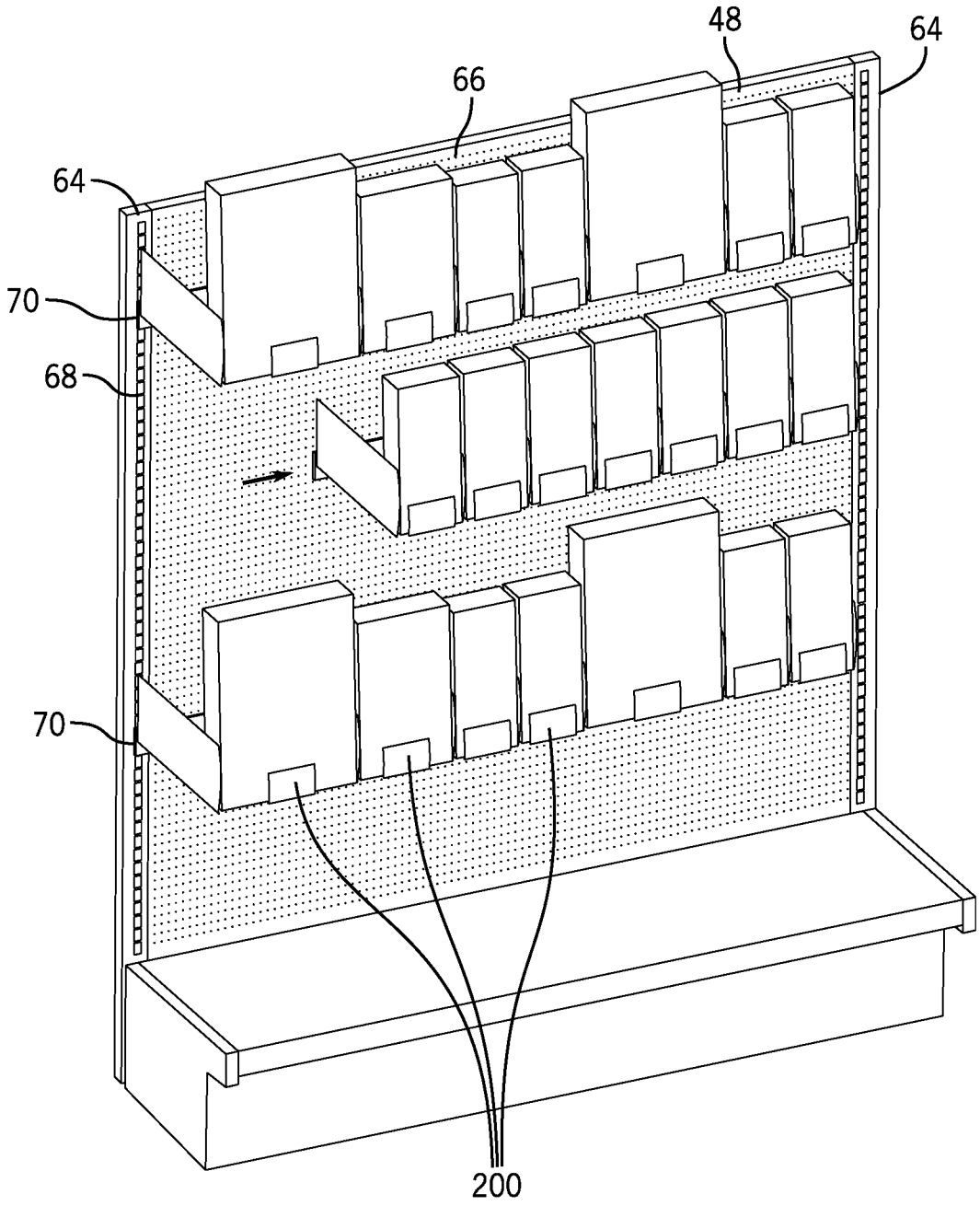
FIG. 21 is a planogram of a plurality of the merchandisers of FIGS. 12-14 mounted on detachable crossbars attached to a gondola.

In some operations, the bracket 112 will be utilized to mount merchandisers 100 and/or 200 to different support structures within a single planogram. FIG. 21 is a planogram having a gondola 66 with a pegwall 48. The gondola 66 has spaced vertical uprights 64 having openings or apertures 68. A crossbar 70 is supported by the vertical uprights 64 and in turn supports a plurality of merchandisers 200. As shown, each of the merchandisers 200 is mounted to a crossbar 70. However, one or more of the merchandisers 200 could be mounted to the pegwall 48 in the method described above.

Figure 22:
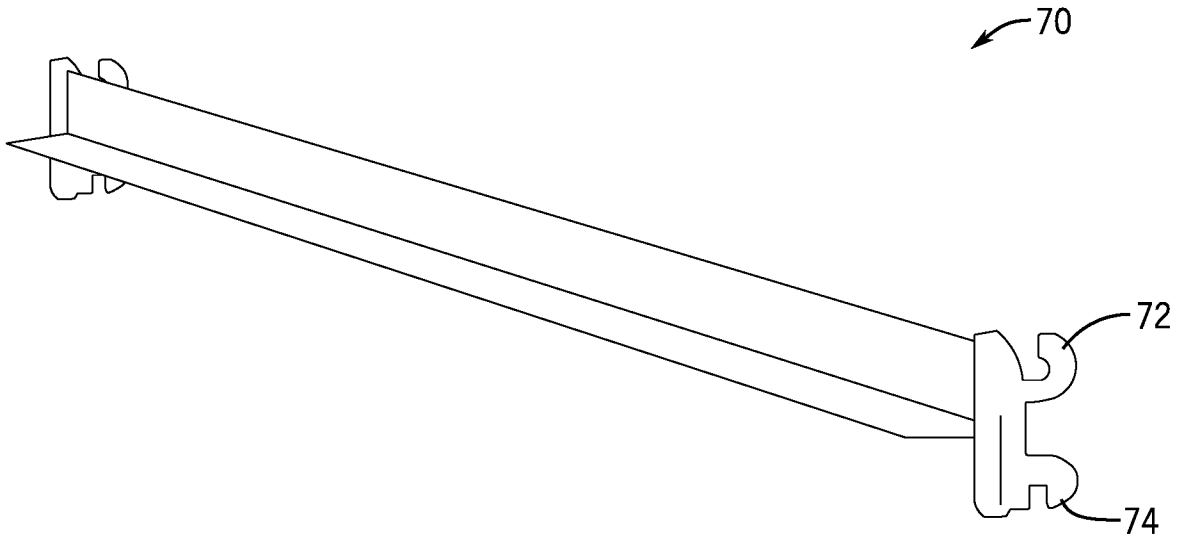
FIG. 22 is a perspective view of one of the crossbars shown in FIG. 21.

As shown in FIG. 22, the crossbar 70 has a pair of hooks 72, 74 proximate each end thereof. The hooks 591, 592 extend rearwardly from the crossbar 590. The top hook 72 has a distal end that extends upward. The bottom hook 74 has a distal end that extends downward. To install the crossbar 70 on the gondola 66, the crossbar 70 is tilted backward and the top hook 72 at each end of the crossbar 70 is inserted into a first pair of apertures 68, one aperture in each upright 64. The crossbar 70 is then tilted back down so as to insert the bottom hook 74 at each end of the crossbar 70 into a second pair of apertures 68 below the first pair of apertures 68. The crossbar 70 is then lowered such that the hooks 72, 74 form an interference engagement with inner surfaces of the uprights 64, restricting removal of the crossbar 70 from the gondola 66.

In some forms, the dual hook 72, 74 structure of the crossbar 70 is built into the bracket 112 of the merchandisers 100, 200. Doing so allows the bracket 112 to mount the merchandisers 100, 200 to gondola uprights 64 in addition to the other support structures described herein.

In addition to the exemplary merchandisers 100, 200 described above, the bracket 112 can be incorporated into merchandisers having other features, such as lights, sensors, pullout trays, rotating trays, bottom channel trays, multi-channel trays, or baffled trays as described in greater detail in U.S. Patent Application Publication Nos. 2018/0103775; 2018/0360233; 2017/0251835; 2010/0107670; 2018/0020848; 2017/0273477; and/or 2017/0202369, each of which were incorporated by reference herein above.

Thus, according to the present disclosure, a product display merchandiser 10, 100, 200 comprises a tray 20, 102, 202 having a product supporting surface (e.g., 38*b*, 40*b*, 103); a first sidewall 38, 128, 228 adjacent a first side of the tray 20, 102, 202; a second sidewall 40, 128, 228 adjacent a second side of the tray 20, 102, 202; and a bracket 34, 112 configured to detachably mount the product display merchandiser 10, 100, 200 to a support, such as a pegwall 48 slatwall 54, or crossbar 62, 70. The product display merchandiser 10, 100, 200 is further configured with at least one of the following: the first and second sidewalls 38, 40 each having a respective sidewall vertical portion 38*a*, 40*a* with a rear edge 38*e*, 40*e* that is angled away from a rear of the product display merchandiser 10; the bracket 34 having a tray-supporting portion (such as tab 34*a*) that is oriented at an acute angle with respect to a support-engaging portion (such as cross-member 34*d*); and/or the bracket 112 having at least two types of engagement members (such as upward hooks 112*a*, rear flange 112*b*, channel 112*c*, or ribs 112*d*) for mounting the product display merchandiser 10, 100, 200 to either of at least two types of supports, such as a pegwall 48 slatwall 54, or crossbar 62, 70.

According to another example, a product display merchandiser 10, 100, 200 comprises a tray 20, 102, 202 having a product supporting surface (e.g., 38*b*, 40*b*, 103); a first sidewall 38, 128, 228 adjacent a first side of the tray 20, 102, 202; a second sidewall 40, 128, 228 adjacent a second side of the tray 20, 102, 202; and a bracket 34, 112 having at least one upward hook 34*f*, 112*a* configured to detachably mount the product display merchandiser 10, 100, 200 to a pegwall 48. The product display merchandiser 10, 100, 200 is further configured with at least one of the following in order to facilitate mounting of the product display merchandiser 10, 100, 200 to the pegwall 48: the first and second sidewalls 38, 40 each having a respective sidewall vertical portion 38*a*, 40*a* with a rear edge 38*e*, 40*e* that is angled away from a rear of the product display merchandiser 10; and/or the bracket 34 having a tray-supporting portion (e.g., tab 34*a*) that is oriented at an acute angle with respect to a pegwall-engaging portion (e.g., cross-member 34*d*).

The product display merchandiser 10, 100, 200 may further comprise a pusher 28, 122, 222 engaged with the tray 20, 102, 202 and longitudinally slidable with respect thereto. In some examples, the first and second sidewalls 38, 40, 228 may be slidable in a lateral direction with respect to the tray 20, 202.

In one example, a support member 36 is attached to the tray-supporting portion (e.g., tab 34*a*) of the bracket 34, and the support member 36 supports the tray 20. In such an example, a base plate 42 is situated below the support member 36 and has clips 42*a*, 42*c* connecting the support member 36 to the tray 20.

In some examples, the bracket 34, 112 includes at least one upward hook 34*f*, 112*a* configured to fit into a hole 49 in a pegwall 48. The bracket 112 may also includes a downward extending flange 112*b* defining the support-engaging portion. In one example, the bracket 112 includes a downward facing channel 112*c* configured to receive a crossbar 62, 70. Thus, in addition to the at least one upward hook 112*a*, the bracket 112 has at least one additional type of engagement member 112*b*-112*d* for mounting the product display merchandiser 100, 200 to a support other than the pegwall 48.

In one example, the tray-supporting portion (e.g., tab 34*a*) of the bracket 34 is angled at an angle of between 87 degrees and 88.5 degrees with respect to the support-engaging portion (e.g., cross-member 34*d*) of the bracket 34. For example, referring to FIG. 4, the angle between tab 34*a* and legs 34*e* is shown as θ. When θ is between 87 and 88.5 degrees, this achieves the desired value of the angle β (FIG. 9) of between 1.5 and 3 degrees. Looked at another way, the tray-supporting portion (e.g., tab 34*a*) is oriented at an obtuse angle with respect to a different pegwall-engaging portion (e.g., legs 34*e*) of the bracket 34, and in one example, the obtuse angle is between 91.5 and 93 degrees. In general, in order to orient the product display merchandiser 10 at an angle (e.g., β) from horizontal, the tray-supporting portion of the bracket 34 should be non-perpendicular (but still within a few degrees of perpendicular) with respect to the support/pegwall-engaging portion(s) of the bracket 34.

In the present description, certain terms have been used for brevity, clarity, and understanding. No unnecessary limitations are to be implied therefrom beyond the requirement of the prior art because such terms are used for descriptive purposes only and are intended to be broadly construed. The different parts and assemblies described herein may be used alone or in combination with other parts and assemblies. Various equivalents, alternatives, and modifications are possible within the scope of the appended claims. Each limitation in the appended claims is intended to invoke interpretation under 35 USC § 112(f), only if the terms "means for" or "step for" are explicitly recited in the respective limitation.

What is claimed is:

1. A product display merchandiser comprising:
a tray having a product supporting surface;
a first sidewall adjacent a first side of the tray;
a second sidewall adjacent a second side of the tray; and
a bracket configured to detachably mount the product display merchandiser to a support,
the bracket having a tray-supporting portion that extends forwardly toward the tray and is oriented at an acute angle with respect to a vertical support-engaging portion.

2. The product display merchandiser of claim 1, further comprising a pusher engaged with the tray and longitudinally slidable with respect thereto.

3. The product display merchandiser of claim 2, further comprising a support member attached to the tray-supporting portion of the bracket, the support member supporting the tray.

4. The product display merchandiser of claim 3, wherein the support member is attached to the tray-supporting portion of the bracket by way of a bolt.

5. The product display merchandiser of claim 3, further comprising a base plate below the support member and having clips connecting the support member to the tray.

6. The product display merchandiser of claim 1, wherein the bracket includes at least one upward hook configured to fit into a hole in a pegwall.

7. The product display merchandiser of claim 6, wherein the bracket includes a downward facing channel configured to receive a crossbar.

8. The product display merchandiser of claim 6, wherein the bracket includes a downward extending flange defining the vertical support-engaging portion.

9. The product display merchandiser of claim 1, wherein the tray-supporting portion of the bracket is angled at an angle of between 87 degrees and 88.5 degrees with respect to the vertical support-engaging portion of the bracket.

10. The product display merchandiser of claim 1, wherein the first and second sidewalls are slidable in a lateral direction with respect to the tray.

11. A product display merchandiser comprising:
a tray having a product supporting surface;
a first sidewall adjacent a first side of the tray;
a second sidewall adjacent a second side of the tray; and
a bracket having at least one upward hook configured to detachably mount the product display merchandiser to a pegwall,
the bracket having a tray-supporting portion that extends forwardly toward the tray and is oriented at an acute angle with respect to a vertical pegwall-engaging portion.

12. The product display merchandiser of claim 11, further comprising a pusher engaged with the tray and longitudinally slidable with respect thereto.

13. The product display merchandiser of claim 12, further comprising a support member attached to the tray-supporting portion of the bracket, the support member supporting the tray.

14. The product display merchandiser of claim 13, wherein the support member is attached to the tray-supporting portion of the bracket by way of a bolt.

15. The product display merchandiser of claim 13, further comprising a base plate below the support member and having clips connecting the support member to the tray.

16. The product display merchandiser of claim 11, wherein the bracket includes a downward facing channel configured to receive a crossbar.

17. The product display merchandiser of claim 11, wherein the bracket includes a downward extending flange defining the vertical pegwall-engaging portion.

18. The product display merchandiser of claim 11, wherein the tray-supporting portion of the bracket is angled at an angle of between 87 degrees and 88.5 degrees with respect to the vertical pegwall-engaging portion of the bracket.

19. The product display merchandiser of claim 11, wherein the first and second sidewalls are slidable in a lateral direction with respect to the tray.

20. The product display merchandiser of claim 1, wherein the first and second sidewalls each have a respective sidewall vertical portion with a rear edge that extends upwardly from a rounded lower portion proximate the tray, wherein the rear edge is angled away from a rear of the product display merchandiser.

21. The product display merchandiser of claim 1, wherein the bracket has at least two types of engagement members for mounting the product display merchandiser to either of at least two types of supports.

22. The product display merchandiser of claim 11, wherein the first and second sidewalls each have a respective sidewall vertical portion with a rear edge that extends upwardly from a rounded lower portion proximate the tray, wherein the rear edge is angled away from a rear of the product display merchandiser.

* * * * *